US008292292B2

(12) United States Patent
Onodera

(10) Patent No.: US 8,292,292 B2
(45) Date of Patent: Oct. 23, 2012

(54) PAPER SHEET OBVERSE AND REVERSE SIDE ARRANGING DEVICE

(75) Inventor: Yasuhiro Onodera, Tsukuba (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 0 days.

(21) Appl. No.: 12/890,925

(22) Filed: Sep. 27, 2010

(65) Prior Publication Data

US 2011/0074085 A1 Mar. 31, 2011

(30) Foreign Application Priority Data

Sep. 29, 2009 (JP) ..... P2009-223598

(51) Int. Cl.
*B65H 29/00* (2006.01)

(52) U.S. Cl. ..... 271/186; 271/184; 271/225

(58) Field of Classification Search ..... 271/184, 271/185, 186, 187, 225
See application file for complete search history.

(56) References Cited

U.S. PATENT DOCUMENTS

| | | | | |
|---|---|---|---|---|
| 4,693,464 | A * | 9/1987 | Honma | 271/265.02 |
| 7,306,219 | B2 * | 12/2007 | Keil et al. | 271/225 |
| 7,946,577 | B2 * | 5/2011 | Asari et al. | 271/186 |
| 2003/0057636 | A1 * | 3/2003 | Ina et al. | 271/186 |

FOREIGN PATENT DOCUMENTS

| | | | |
|---|---|---|---|
| JP | 59022847 | A * | 2/1984 |
| JP | 62185671 | A * | 8/1987 |
| JP | 63212666 | A * | 9/1988 |
| JP | 02163260 | A * | 6/1990 |
| JP | 5-186120 | | 7/1993 |
| JP | A-2007-050951 | | 3/2007 |
| JP | 2011073797 | A * | 4/2011 |

OTHER PUBLICATIONS

Korean Office Action; Application No. 10-2010-0092896; dated Apr. 6, 2012.

* cited by examiner

*Primary Examiner* — Kaitlin Joerger
(74) *Attorney, Agent, or Firm* — Nixon & Vanderhye P.C.

(57) ABSTRACT

A paper sheet obverse and reverse side arranging device according to the present invention, includes: a reversible conveying section which includes a rotor reversibly conveying paper sheets in two directions opposite to each other, and two inlet and outlet sections provided in front of the two directions, respectively; a sorting section which is provided in an upstream conveying path upstream from the reversible conveying section, and which sorts paper sheets to either one of the two inlet and outlet sections; two guiding sections which are provided in the two inlet and outlet sections, respectively, and which guide paper sheets conveyed from the reversible conveying section; two guide conveying sections which convey paper sheets guided from the reversible conveying section by the two guiding sections towards a downstream conveying path provided downstream; and a control section which controls the reversible conveying section and the sorting section.

18 Claims, 7 Drawing Sheets

PAPER SHEET OBVERSE AND REVERSE SIDE ARRANGING DEVICE

BACKGROUND OF THE INVENTION

1. Field of the Invention

The present invention relates to a paper sheet obverse and reverse side arranging device.

Priority is claimed on Japanese Patent Application No. 2009-223598, filed Sep. 29, 2009, the content of which is incorporated herein by reference.

2. Description of Related Art

Japanese Unexamined Patent Application, First Publication No. H05-186120 discloses a paper sheet obverse and reverse side sorting device which sorts paper sheets requiring inversion from paper sheets not requiring inversion. This paper sheet obverse and reverse side arranging device employs a switchback method in which paper sheets not requiring inversion are fed into a U-turn conveying path and conveyed as is, whereas paper sheets requiring inversion are fed into a switchback inverting path and inverted before merging with the end of the U-turn conveying path.

However, in a paper sheet obverse and reverse side arranging device employing such a switchback method, the construction thereof dictates that until a paper sheet fed into the switchback inverting path is inverted and discharged from the switchback inverting path, subsequent paper sheets cannot be introduced into the switchback inverting path. Accordingly, when consecutive paper sheets requiring inversion appear, because the succeeding paper sheet requiring inversion can be introduced into the switchback inverting path only after the preceding paper sheet requiring inversion has been discharged from the switchback inverting path, a long feed interval for paper sheets is required. Therefore, there is a problem in that the paper feed rate is poor.

SUMMARY OF THE INVENTION

An object of the present invention is to provide a paper sheet obverse and reverse side arranging device which can improve feed efficiency by reducing the feed interval of the paper sheets.

In order to achieve the aforementioned object, a paper sheet obverse and reverse side arranging device according to the present invention, includes: a reversible conveying section which includes a rotor reversibly conveying paper sheets in two directions opposite to each other, and two inlet and outlet sections provided in front of the two directions, respectively; a sorting section which is provided in an upstream conveying path upstream from the reversible conveying section, and which sorts paper sheets to either one of the two inlet and outlet sections; two guiding sections which are provided in the two inlet and outlet sections, respectively, and which guide paper sheets conveyed from the reversible conveying section; two guide conveying sections which convey paper sheets guided from the reversible conveying section by the two guiding sections towards a downstream conveying path provided downstream; and a control section which controls the reversible conveying section and the sorting section.

With this structure, when a paper sheet requiring inversion is conveyed along an upstream conveying path, a control section introduces the paper sheet requiring inversion from one of two inlet and outlet sections to a reversible conveying device including a rotor by means of a sorting section, reverses conveyance of the reversible conveying section and guides the paper sheet requiring inversion from the inlet and outlet section by way of a guiding section, and then conveys the paper sheet to a downstream conveying path by a guide conveying section associated with this guiding section. Furthermore, when a paper sheet not requiring inversion is conveyed along the upstream conveying path, the control section introduces the paper sheet not requiring inversion from one of two inlet and outlet section to the reversible conveying section by means of the sorting section, and continues turning the reversible conveying section in the same direction so that the paper sheet not requiring inversion is guided from the other inlet and outlet section by way of a guiding section, and is then conveyed to the downstream conveying path by a guide conveying section associated with this guiding section. Thus, the paper sheets present consistent obverse and reverse sides in the downstream conveying path. Moreover, when the conveyance of the reversible conveying section is reversed, by switching the sorting direction of the sorting section to the opposite side, the next paper sheet can be introduced to the reversed reversible conveying section from the other inlet and outlet section after a short interval. Furthermore, when the conveyance of the reversible conveying section is not reversed, by not switching the sorting direction of the sorting section to the opposite side, the next paper sheet can be introduced from the one inlet and outlet section to the reversed reversible conveying section after a short interval. Accordingly, the feed interval of the paper sheets can be shortened, thereby improving feed efficiency. Moreover, because components which strike the paper sheets that require inversion can be eliminated, the paper sheets are not damaged by striking, and can be inverted in a favorable manner.

In the paper sheet obverse and reverse side arranging device, the two inlet and outlet sections may be disposed in close proximity, and a region on an outer peripheral surface of the reversible conveying section on a distant side of the two inlet and outlet sections may constitute a forward and reverse conveying path which reversibly conveys paper sheets.

With this structure, because the two inlet and outlet sections are disposed in close proximity, the sorting section can perform sorting more easily. Furthermore, the two inlet and outlet sections are disposed in close proximity, and the region on the outer peripheral surface of the reversible conveying section on the distant side of the two inlet and outlet sections constitutes a forward and reverse conveying path which reversibly conveys paper sheets. Therefore, in the event of a switchback process in which a paper sheet requiring inversion is introduced from one of the inlet and outlet sections to the reversible conveying section, the conveyance of the reversible conveying section is reversed, and the paper sheet requiring inversion is guided from that inlet and outlet section by the guiding section, the paper sheet requiring inversion can be subjected to switchback in a favorable manner in the forward and reverse conveying path, and moreover, the size of the reversible conveying section can be reduced.

In the paper sheet obverse and reverse side arranging device, the reversible conveying section may include a circular drum.

With this structure, because the reversible conveying section includes a circular drum, the reversible conveying section can be reduced in size and manufactured at low cost.

In the paper sheet obverse and reverse side arranging device, the guiding sections may include an impeller.

With this structure, because the guiding section includes an impeller, the guiding section can be reduced in size and manufactured at low cost.

In the paper sheet obverse and reverse side arranging device, in response to sorting section introducing a paper sheet requiring inversion from one of the inlet and outlet sections to the reversible conveying section, the control section may perform reverse operation control by reversing conveyance of the reversible conveying section so that the paper sheet requiring inversion exits from the one of the inlet and outlet sections. On the other hand, in response to the sorting section introducing a paper sheet not requiring inversion from one of the inlet and outlet sections to the reversible conveying section, the control section may perform continued operation control by not reversing conveyance of the reversible conveying section so that the paper sheet not requiring inversion exits from the other of the inlet and outlet sections. Moreover, the control section may perform switching operation control to switch a sorting direction of the sorting section to an opposite side only during the reverse operation control.

With this structure, in response to sorting section introducing a paper sheet requiring inversion from one of the inlet and outlet sections to the reversible conveying section, the control section performs reverse operation control by reversing conveyance of the reversible conveying section so that the paper sheet requiring inversion exits from the one of the inlet and outlet sections. On the other hand, in response to the sorting section introducing a paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections. Thus, the paper sheets present consistent obverse and reverse sides in the downstream conveying path. Moreover, during reverse operation control, by switching the sorting direction of the sorting section to the opposite side, the next paper sheet can be introduced from the other inlet and outlet section to the reversed reversible conveying section after a short interval. Furthermore, during continued operation control, by not switching the sorting direction of the sorting section to the opposite side, the next paper sheet can be introduced from the same inlet and outlet section to the reversible conveying section, which has not been reversed, after a short interval. Accordingly, the feed interval of the paper sheets can be shortened, thereby improving feed efficiency.

In the paper sheet obverse and reverse side arranging device, the control section, during the reverse operation control, may reverse conveyance of the reversible conveying section at a timing such that a trailing end of a paper sheet requiring inversion has at least passed the guiding section provided in the inlet and outlet section to which the paper sheet requiring inversion was introduced.

With this structure, the control section, during the reverse operation control, reverses conveyance of the reversible conveying section at a timing such that a trailing end of a paper sheet requiring inversion has at least passed the guiding section provided in the inlet and outlet section to which the paper sheet requiring inversion was introduced. Therefore the paper sheet requiring inversion can be reliably discharged from the same inlet and outlet section.

In the paper sheet obverse and reverse side arranging device, the control section, during the switching operation control, may switch a sorting direction of the sorting section to an opposite side at a timing such that a trailing end of a paper sheet requiring inversion has at least passed the sorting section.

With this structure, the control section, during the switching operation control, switches a sorting direction of the sorting section to an opposite side at a timing such that a trailing end of a paper sheet requiring inversion has at least passed the sorting section. Therefore the sorting direction of the sorting section can be changed to the opposite side without damaging the paper sheet requiring inversion.

In the paper sheet obverse and reverse side arranging device, the two inlet and outlet sections, the two guiding sections, and the two guide conveying sections may be disposed symmetrically about a line connecting the sorting section and the reversible conveying section.

With this structure, the two inlet and outlet sections are disposed symmetrically about a line connecting the sorting section and the reversible conveying section. Therefore both inlet and outlet sections have the same sorting conditions. Furthermore, the two guiding sections and two guide conveying sections are also disposed symmetrically about a line connecting the sorting section and the reversible conveying section. Therefore a paper sheet introduced from one inlet and outlet section then conveyed from the other inlet and outlet section by the guide section and the associated guide conveying section, and a paper sheet introduced from the other inlet and outlet section then conveyed from the one inlet and outlet section by the guide section and the associated guide conveying section, can be conveyed according to the same conditions. In addition, a paper sheet introduced from one inlet and outlet section then conveyed from that same inlet and outlet section by the guide section and the associated guide conveying section, and a paper sheet introduced from the other inlet and outlet section then conveyed from that same inlet and outlet section by the guide section and the associated guide conveying section, can be conveyed according to the same conditions. Accordingly, the control by the control section is simplified.

In the paper sheet obverse and reverse side arranging device, a forward and reverse conveying path may be provided between the two inlet and outlet sections on an opposite side to the sorting section side in the reversible conveying section. In response to the sorting section introducing a paper sheet requiring inversion from one of the inlet and outlet sections to the reversible conveying section, the control section, immediately prior to when a central region of the paper sheet requiring inversion reaches a central region of the forward and reverse conveying path, may perform reverse operation control by supplying an instruction to the reversible conveying section to reverse conveyance so that the paper sheet requiring inversion exits from the one of the inlet and outlet sections. In response to the sorting section introducing a paper sheet not requiring inversion from one of the inlet and outlet sections to the reversible conveying section, the control section may perform continued operation control by not reversing conveyance of the reversible conveying section so that the paper sheet not requiring inversion exits from the other of the inlet and outlet sections. The control section may perform switching operation control to switch a sorting direction of the sorting section to an opposite side only during the reverse operation control.

With this structure, in response to the sorting section introducing a paper sheet requiring inversion from one of the inlet and outlet sections to the reversible conveying section, the control section, immediately prior to when a central region of the paper sheet requiring inversion reaches a central region of the forward and reverse conveying path, performs reverse operation control by supplying an instruction to the reversible conveying section to reverse conveyance so that the paper sheet requiring inversion exits from the one of the inlet and outlet sections. On the other hand, in response to the sorting section introducing a paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections. Therefore, delays resulting from the time lag caused by the reversal can be suppressed, and paper sheets requiring inversion and paper sheets not requiring inversion can be fed to the downstream conveying path with the same timing from the time of sorting.

In the paper sheet obverse and reverse side arranging device, a forward and reverse conveying path may be provided between the two inlet and outlet sections on an opposite side to the sorting section side in the reversible conveying section. In response to the sorting section introducing a paper sheet requiring inversion from one of the inlet and outlet sections to the reversible conveying section, the control section, at a point when a central region of the paper sheet requiring inversion reaches a central region of the forward and reverse conveying path, may perform reverse operation control by supplying an instruction to reverse the reversible conveying device so that the paper sheet requiring inversion exits from the one of the inlet and outlet sections. In response to the sorting section introducing a paper sheet not requiring inversion from one of the inlet and outlet sections to the reversible conveying section, the control section may perform continued operation control by not reversing the reversible conveying section so that the paper sheet not requiring inversion exits from the other of the inlet and outlet sections. The control section may perform switching operation control to switch a sorting direction of the sorting section to an opposite side only during the reverse operation control.

With this structure, in response to the sorting section introducing a paper sheet requiring inversion from one of the inlet and outlet sections to the reversible conveying section, the control section, at a point when a central region of the paper sheet requiring inversion reaches a central region of the forward and reverse conveying path, performs reverse operation control by supplying an instruction to reverse the reversible conveying device so that the paper sheet requiring inversion exits from the one of the inlet and outlet sections. On the other hand, in response to the sorting section introducing a paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections. Therefore, through simple control, paper sheets requiring inversion and paper sheets not requiring inversion can be fed to the downstream conveying path with substantially the same timing from the time of sorting.

DETAILED DESCRIPTION OF THE INVENTION

A paper sheet obverse and reverse side arranging device according to a first embodiment of the present invention is described below with reference to FIG. 1 to FIG. 7.

The paper sheet obverse and reverse side arranging device according to the first embodiment coordinates the obverse and reverse sides of paper sheets serving as paper sheets. This paper sheet obverse and reverse side arranging device is incorporated into paper sheet processing equipment such as money inpayment and outpayment machines. Although not shown in the figures, the paper sheet processing equipment includes a separating feed out section, a receiving and conveying section, an identification section, a temporary holding section, a storage section, a feed out conveying section, and a control section. The separating feed out section separates each paper sheet from the others inserted into a slot and feeds the sheets into the equipment at intervals. The receiving and conveying section conveys the paper sheets fed out from the separating feed out section. The identification section identifies the paper sheets being transported by the receiving and conveying section. The temporary holding section sorts the paper sheets identified by the identification section and conveyed by the conveying section, by type, and accumulates and temporarily holds them. The storage section receives as a batch, the paper sheets in the temporary storage section per denomination, and stores the paper sheets in a manner ready to be fed out. The feed out conveying section conveys the paper sheets fed out from the storage section to a dispensing slot. The control section controls the separating feed out section, receiving and conveying section, identification section, temporary holding section, storage section, and feed out conveying section.

Figure 1:
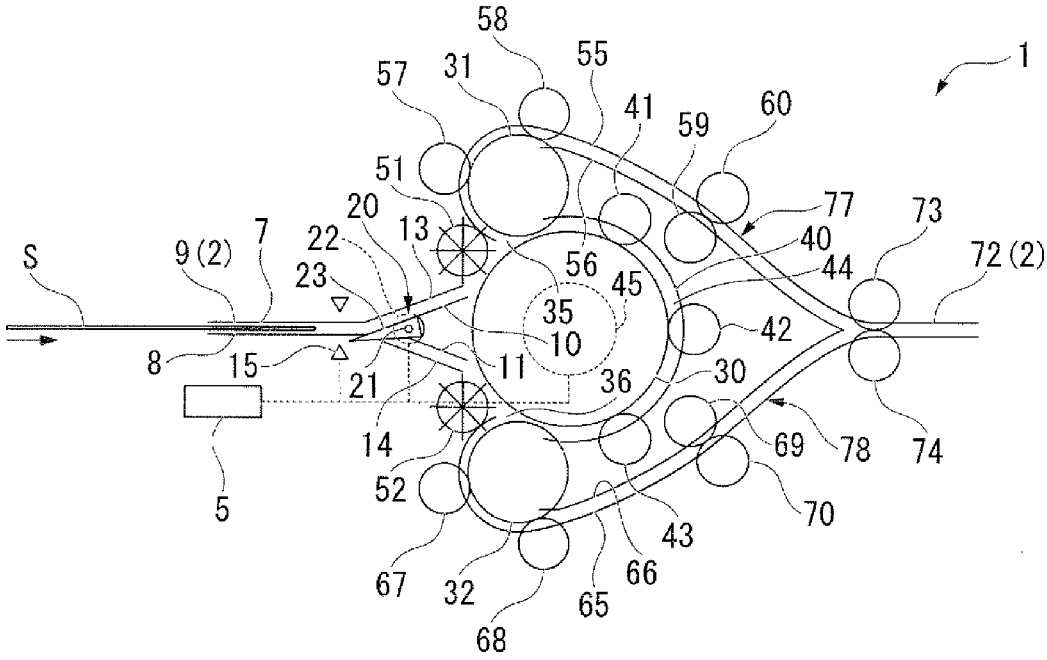
FIG. 1 is a side view showing a paper sheet obverse and reverse side arranging device according to a first embodiment of the present invention.

As shown in FIG. 1, a paper sheet obverse and reverse side arranging device (also simply referred to as the "arranging device" below) 1 according to the first embodiment is provided in the abovementioned receiving and conveying section 2 of the paper sheet processing equipment, between the identification section and the temporary holding section (not shown in the figure). The arranging device 1, according to control commands issued by a control section 5 based on the identification results of the obverse and reverse side information obtained by the identification section on the upstream side, sorts the obverse and reverse sides of the paper sheets S to give a uniform direction, and feeds the paper sheets to the temporary holding section on the downstream side.

As shown in FIG. 1, the paper sheet obverse and reverse side arranging device 1 according to the first embodiment includes a single straight upstream conveying path 9. The upstream path 9 is constituted by a pair of guide plates 7 and 8 which form part of the receiving and conveying section 2. The pair of guide plates 7 and 8 are inclined in opposing directions so that the ends thereof open outwards. Between the ends of the pair of guide plates 7 and 8, a pair of guide plates 10 and 11 are disposed parallel to the ends of the pair of guide plates 7 and 8 respectively. The guide plate 10 and the inclined end of the guide plate 7 form a first branching conveying path 13 which branches from the end position of the upstream conveying path 9. The guide plate 11 and the inclined end of the guide plate 8 form a second branching conveying path 14 which branches from the end position of the upstream conveying path 9. Each of the two branching conveying paths 13 and 14 forms obtuse angles relative to the upstream conveying path 9. The two branching conveying paths 13 and 14 have a symmetrical shape with respect to the upstream conveying path 9.

In the upstream conveying path 9, there is provided an optical timing sensor 15 which detects a passing paper sheet S by the light in the light path being blocked by the paper sheet.

On the upstream conveying path 9 side of the branching conveying paths 13 and 14, a sorting section 20 is provided which sorts the paper sheets S conveyed from the upstream conveying path 9 among the two branching conveying paths 13 and 14 in an alternating manner. This sorting section 20 includes a sorting drive section 22 and a sorting member 23. The sorting drive section 22 may be a rotary solenoid, and is controlled by the control section 5 and turns a pivoting shaft 21. The sorting member 23 is secured to the pivoting shaft 21 and pivots about the pivoting shaft 21. The sorting section 20 is positioned at either of a first sorting position shown in FIG. 1, and a second sorting position opposite to the first sorting position. In the case where the sorting section 20 is positioned the first sorting position, it guides the paper sheet S from the upstream conveying path 9 to the branching conveying path 13 by means of the sorting member 23. In the case where the sorting section 20 is positioned at the second sorting position, it guides the paper sheet S from the upstream conveying path 9 to the branching conveying path 14 by means of the sorting member 23.

At the end position of the branching conveying paths 13 and 14, a circular base drum (reversible conveying section, circular drum) 30 is provided which is a rotating body capable of rotation. On the branching conveying path 13 and 14 side of this base drum 30, two rotatable circular inlet and outlet drums 31 and 32 are provided such that each abuts the base drum 30.

Space between the base drum 30 and the first inlet and outlet drum 31 on the branching conveying path 13 side forms a first inlet and outlet section 35 which introduces a paper sheet S, sorted towards the branching conveying path 13 side by the sorting section 20, to the space between the base drum 30 and the first inlet and outlet drum 31. Space between the base drum 30 and the second inlet and outlet drum 32 forms a second inlet and outlet section 36 which introduces a paper sheet S, sorted towards the branching conveying path 14 side by the sorting section 20, to the space between the base drum 30 and the second inlet and outlet drum 31. In other words, the sorting section 20 provided in the upstream conveying path 9 upstream of the base drum 30 sorts the paper sheets S among the two inlet and outlet sections 35 and 36 of the base drum 30 provided for separate conveying directions. With this configuration, the two inlet and outlet sections 35 and 36 are disposed in close proximity to each other along the circumferential direction of the base drum 30. In other words, a distance between two inlet and outlet sections 35 and 36 along the peripheral direction of the base drum 30 is less than the half of the total circumference of the base drum 30. Furthermore, these two inlet and outlet sections 35 and 36 are disposed symmetrically about a line connecting the sorting section 20 and the base drum 30, that is, a line connecting the center of the pivoting shaft 21 and the center of the base drum 30. The two branching conveying paths 13 and 14 which guide the paper sheets S to the two inlet and outlet sections 35 and 36 are also disposed symmetrically about a line connecting the sorting section 20 and the base drum 30.

On the opposite side of the base drum 30 to the sorting section 20 side, a circular arc shaped guide plate 40 is provided with a predetermined space apart from the outer peripheral surface of the base drum 30. Moreover, on the opposite side of the base drum 30 to the sorting section 20 side, a plurality of, specifically three, guide rollers 41 to 43 are provided. These guide rollers 41 to 43 are capable of abutting the outer peripheral surface of the base drum 30 and are capable of sandwiching the paper sheet S against the base drum 30. These guide rollers 41 to 43 are provided in openings (not shown) in the guide plate 40. The region on the distant side of the space between the inlet and outlet sections 35 and 36 on the opposite side of the outer peripheral surface of the base drum 30 to the sorting section 20 side, together with the guide plate 40 and the guide rollers 41 to 43, constitutes a forward and reverse conveying path 44 which conveys the paper sheet S. The region on the distant side may indicate a region which connects the two inlet and outlet sections 35 and 36 to each other along the peripheral direction of the base drum 30, and length of which may be more than the half of the total circumference of the base drum 30. This forward and reverse conveying path 44 has a peripheral length equal to or longer than the entire length of the paper sheet S along the conveying direction. The base drum 30 is driven by a reversible motor 45 controlled by the control section 5 at a predetermined reduction ratio which is constant with respect to the reversible motor 45, enabling the paper sheet S to be conveyed in a reversible manner. The inlet and outlet drums 31 and 32 are driven by the motor 45 in the opposite direction to the rotation direction of the base drum 30 at a predetermined reduction ratio with respect to this motor 45. The guide rollers 41 to 43, by contact with the base drum 30 or the paper sheet S against the base drum 30, co-rotate with the base drum 30.

The forward and reverse conveying path 44 also forms a symmetrical shape about the line connecting the sorting section 20 and the base drum 30.

In the first inlet and outlet section 35, an impeller (guide section) 51 is provided which separates the paper sheet S, fed out from the forward and reverse conveying path 44 through this inlet and outlet section 35, from the base drum 30, and guides the paper sheet to the inlet and outlet drum 31 side. In the second inlet and outlet section 36, an impeller (guide section) 52 is provided which separates the paper sheet S, fed out from the forward and reverse conveying path 44 via the inlet and outlet section 36, from the base drum 30, and guides the paper sheet to the inlet and outlet drum 32 side. These two impellers 51 and 52 are disposed symmetrically about a line connecting the sorting section 20 and the base drum 30. The impellers 51 and 52 are driven by a different motor (not shown) from the motor 45 at a predetermined reduction ratio which is constant with respect to this motor. The impeller 51 is constantly driven in such a direction that the inlet and outlet section 35 side thereof moves from the base drum 30 towards the inlet and outlet drum 31 side (counterclockwise in FIG. 1). The impeller 52 is driven in such a direction that the inlet and outlet section 36 side thereof moves from the base drum 30 towards the inlet and outlet drum 32 side (clockwise in FIG. 1).

From the upstream conveying path 9 side of the first inlet and outlet drum 31 to the opposite side to the base drum 30 side, a guide plate 55 is provided with a predetermined space apart from the outer peripheral surface of the inlet and outlet drum 31. This guide plate 55 also extends from the section space apart from the inlet and outlet drum 31 in a direction away from the upstream conveying path 9. Moreover, on the base drum 30 side of the section of the guide plate 55 which extends from the inlet and outlet drum 31 in the direction away from the upstream conveying path 9, a guide plate 56 is provided with a predetermined space apart from the guide plate 55. In addition, on the upstream conveying path 9 side of the inlet and outlet drum 31 as well as the opposite side to the base drum 30 side, a plurality of, specifically two, guide rollers 57 and 58 are provided. The guide rollers 57 and 58 are capable of abutting the outer peripheral surface of the inlet and outlet drum 31 and are capable of sandwiching the paper sheet S against the inlet and outlet drum 31. The guide rollers 57 and 58 are positioned in openings (not shown) in the guide plate 55. Furthermore, at the center position in the extending direction of the guide plate 55 and the guide plate 56, a pair of conveying rollers 59 and 60 are provided. The conveying rollers 59 and 60 are capable of contacting each other between the guide plate 55 and guide plate 56 and are capable of sandwiching the paper sheet S. The conveying rollers 59 and 60 are positioned in openings (not shown) in the guide plate 55 and guide plate 56. The conveying roller 59 is driven by a different motor (not shown) from the motor 45 at a predetermined reduction ratio which is constant with respect to this motor. The conveying roller 59 rotates in such a direction that the conveying roller 60 side moves away from the upstream conveying path 9 (clockwise in FIG. 1). On the other hand, the guide rollers 57 and 58, by contact with the inlet and outlet drum 31 or the paper sheet S against the inlet and outlet drum 31, co-rotate with the inlet and outlet drum 31. The conveying roller 60, by contact with the conveying roller 59 or the paper sheet S against the conveying roller 59, co-rotates with the conveying roller 59.

From the upstream conveying path 9 side of the second inlet and outlet drum 32 to the opposite side to the base drum 30 side, a guide plate 65 is provided with a predetermined space apart from the outer peripheral surface of the inlet and outlet drum 32. This guide plate 65 also extends from the section space apart from the inlet and outlet drum 32 in a direction away from the upstream conveying path 9. Moreover, on the base drum 30 side of the section of the guide plate 65 which extends from the inlet and outlet drum 32 in the direction away from the upstream conveying path 9, a guide plate 66 is provided with a predetermined space apart from the guide plate 65. In addition, on the upstream conveying path 9 side of the inlet and outlet drum 32 as well as the opposite side to the base drum 30 side, a plurality of, specifically two, guide rollers 67 and 68 are provided. The guide rollers 67 and 68 are capable of abutting the outer peripheral surface of the inlet and outlet drum 32 and are capable of sandwiching the paper sheet S against the inlet and outlet drum 32. The guide rollers 67 and 68 are positioned in openings (not shown) in the guide plate 65. Furthermore, at the center position in the extending direction of the guide plate 65 and the guide plate 66, a pair of conveying rollers 69 and 70 are provided. The conveying rollers 69 and 70 contact each other between the guide plate 65 and guide plate 66 and sandwich the paper sheet S. The conveying rollers 69 and 70 are positioned in openings (not shown) in the guide plates 65 and 66. The conveying roller 69 is driven by a different motor (not shown) from the motor 45 at a predetermined reduction ratio which is constant with respect to this motor. The conveying roller 69 rotates in such a direction that the conveying roller 70 side moves away from the upstream conveying path 9 (clockwise in FIG. 1). On the other hand, the guide rollers 67 and 68, by contact with the inlet and outlet drum 32 or the paper sheet S against the inlet and outlet drum 32, co-rotate with the inlet and outlet drum 32. The conveying roller 70, by contact with the conveying roller 69 or the paper sheet S against the conveying roller 69, co-rotates with the conveying roller 69.

The ends of the guide plates 56 and 66 on the opposite side to the upstream conveying path 9 side are connected to each other. The ends of the guide plates 55 and 65 on the opposite side to the upstream conveying path 9 side are parallel to each other, and constitute a downstream conveying path 72 which serves as part of the receiving and conveying section 2. In this downstream conveying path 72, a pair of conveying rollers 73 and 74 are provided which are capable of contacting each other and sandwiching the paper sheet S. The conveying roller 73 is driven by a different motor (not shown) from the motor 45 at a predetermined reduction ratio which is constant with respect to this motor. The conveying roller 73 rotates in such a direction that the conveying roller 74 side moves away from the upstream conveying path 9 (counterclockwise in FIG. 1). The conveying roller 74, by contact with the conveying roller 73 or the paper sheet S against the conveying roller 73, co-rotates with the conveying roller 73. The impellers 51 and 52 and the conveying rollers 59, 69, and 73 whose rotation directions are always constant are driven by a common motor.

The inlet and outlet drum 31, the guide plates 55 and 56, the guide rollers 57 and 58, and the conveying rollers 59 and 60 constitute a guide conveying path (guide conveying section) 77. The guide conveying path 77 conveys the paper sheet S, which exits the first inlet and outlet section 35 and is separated from the base drum 30 by the impeller 51, towards the downstream conveying path 72 located downstream. The inlet and outlet drum 32, the guide plates 65 and 66, the guide rollers 67 and 68, and the conveying rollers 69 and 70 constitute a guide conveying path (guide conveying section) 78. The guide conveying path 78 conveys the paper sheet S, which exits the second inlet and outlet section 36 and is separated from the base drum 30 by the impeller 52, towards the downstream conveying path 72 located downstream. These two guide conveying paths 77 and 78 form a symmetrical shape about a line connecting the sorting section 20 and the base drum 30. The upstream conveying path 9 and the downstream conveying path 72 are collinear with the line connecting the sorting section 20 and the base drum 30.

Next, the operation of the paper sheet obverse and reverse side arranging device 1 with the above construction is described together with details of the control performed by the control section 5.

Figure 2:
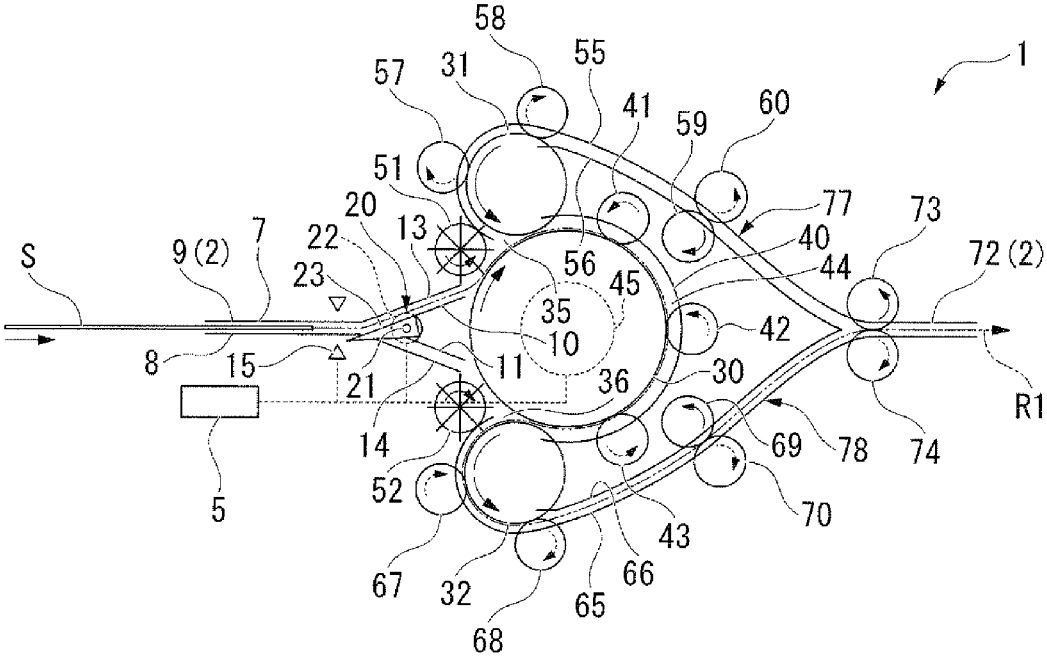
FIG. 2 is a side view of the paper sheet obverse and reverse side arranging device according to the first embodiment of the present invention, showing a first non-inverting conveying route R1.

The paper sheet obverse and reverse side arranging device 1 causes the paper sheets S conveyed from the upstream conveying path 9 to be in a condition where their obverse and reverse side directions face in a uniform direction (i.e., orientations of the paper sheets S in the thickness direction are the same to each other) in the downstream conveying path 72. For example, a case of arranging paper sheets S so that the obverse side in the figures of the downstream conveying path 72 is the upper side and the reverse side in the figures of the downstream conveying path 72 is the lower side, is described. As shown in FIG. 2, when the sorting section 20 is positioned at a first sorting position, the base drum 30, the impeller 52, and the conveying roller 59 rotate in the clockwise direction in FIG. 2, and the inlet and outlet drums 31 and 32, the impeller 51, the conveying roller 69, and the conveying roller 73 rotate in the counterclockwise direction in FIG. 2. Furthermore, the guide rollers 41 to 43, 57, 58, 67, and 68 and the conveying rollers 60 and 70 co-rotate by contact with their respective counterparts. In the figure, rotation performed at a constant predetermined reduction ratio with respect to rotation of the motor 45 or a motor not shown in the figure is indicated by an arrow with a solid line, and co-rotation is indicated by an arrow with a broken line.

In the state shown in FIG. 2, when the paper sheet S is conveyed from the upstream conveying path 9, the control section 5, from the identification results of the identification section on the upstream side (not shown), if this paper sheet S is a paper sheet not requiring inversion having an inversion not required orientation where the obverse side is the upper side in FIG. 2 and the reverse side is the lower side in FIG. 2, does not perform switching operation control to switch the sorting direction of the sorting section 20 to the opposite side even after the timing sensor 15 detects the trailing end of the paper sheet S. This paper sheet S, by the sorting member 23 of the sorting section 20 in the first sorting position as shown in FIG. 2, is introduced from the branching conveying path 13 into the first inlet and outlet section 35, and then introduced into the forward and reverse conveying path 44 by the base drum 30 and the inlet and outlet drum 31. In this case, the control section 5, because this paper sheet S is a paper sheet not requiring inversion, performs continued operation control whereby the paper sheet S exits as is from the second inlet and outlet section 36, by not reversing the rotation of the motor 45, that is, the base drum 30 and the inlet and outlet drums 31 and 32. As a result, the paper sheet S is guided by the guide plate 40 in the forward and reverse conveying path 44 and sandwiched and conveyed by the base drum 30 and the guide rollers 41 to 43 until reaching the second inlet and outlet section 36, where the leading end exits from the inlet and outlet section 36. Whereupon, the impeller 52 separates the leading end of the paper sheet S from the base drum 30, and guides the paper sheet S into the guide conveying path 78 between the inlet and outlet drum 32 and the guide plate 65. The paper sheet S, in the guide conveying path 78, with guidance by the guide plates 65 and 66, is sandwiched and conveyed by the inlet and outlet drum 32 and the guide rollers 67 and 68, the conveying rollers 69 and 70, and the conveying rollers 73 and 74 until reaching the downstream conveying path 72. As a result, the paper sheet S, in the downstream conveying path 72, is orientated with the obverse side on the upper side in FIG. 2 and the reverse side on the lower side in FIG. 2. By this process, the paper sheet S, which is a paper sheet not requiring inversion introduced with the sorting section 20 positioned at the first sorting position, is conveyed at a constant speed along the first non-inverting conveying route R1 shown by the two dot chain line in FIG. 2.

Description will be made hereafter about a case where it is also not necessary to inverse the paper sheet S next conveyed by the upstream conveying path 9 in the paper sheet obverse and reverse side arranging device 1 after the paper sheet S conveyed by the first non-inverting conveying route R1. In this case, the control section 5 also subjects this paper sheet S to continued operation control without performing switching operation control as mentioned above. As a result, the paper sheet S is conveyed along the first non-inverting conveying route R1.

In this manner, when the preceding paper sheet S and succeeding paper sheet S both do not require inversion, and the succeeding paper sheet S is conveyed by the same non-inverting conveying route as the preceding paper sheet S, a gap should be formed in the conveying direction sufficient that the adjacent paper sheets S do not interfere with each other.

Figure 3:
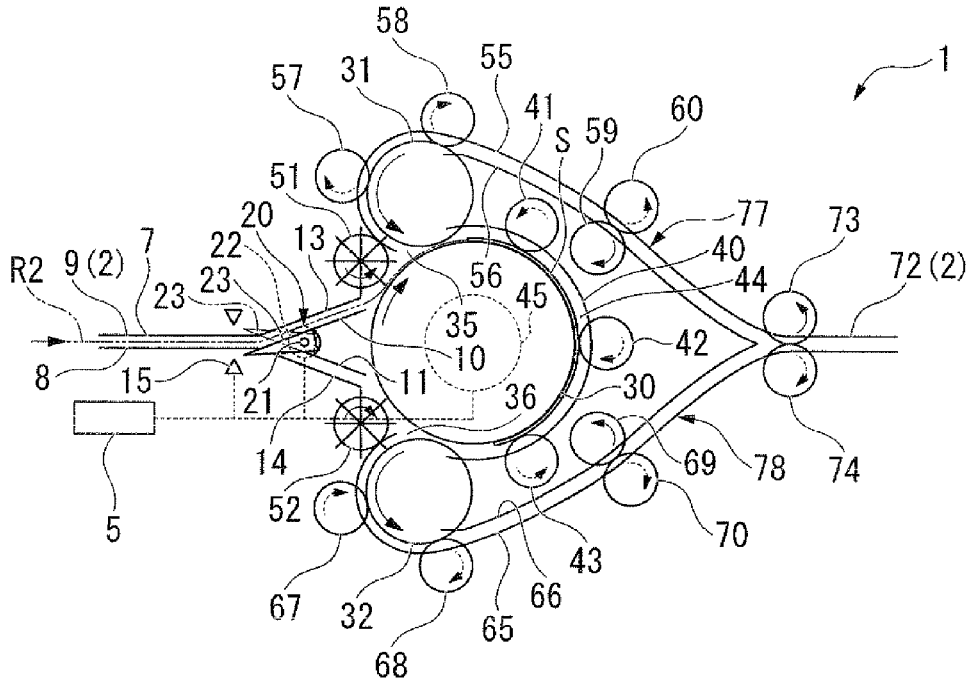
FIG. 3 is a side view of the paper sheet obverse and reverse side arranging device according to the first embodiment of the present invention, showing part of a first inverting conveying route R2.

Description will be made about a case where it is necessary to inverse the paper sheet S next conveyed by the upstream conveying path 9 in the paper sheet obverse and reverse side arranging device 1 after the paper sheet S conveyed by the first non-inverting conveying route R1 because of an orientation where the obverse side is the lower side in FIG. 3 and the reverse side is the upper side in FIG. 3, for example. In this case, the control section 5 performs switching operation control, whereby from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the second sorting position, and reversing the orientation of the sorting member 23 as shown by the two dot chain line in FIG. 3. This paper sheet S, by the sorting member 23 of the sorting section 20 in the first sorting position prior to switching in the state indicated by the solid line in FIG. 3, is introduced into the first inlet and outlet section 35 from the branching conveying path 13, introduced into the forward and reverse conveying path 44 by the base drum 30 and the inlet and outlet drum 31, and then with the guidance of the guide plate 40 in the forward and reverse conveying path 44, is sandwiched and conveyed by the base drum 30 and the guide rollers 41 to 43 as shown in FIG. 3. In this case, the control section 5 performs reverse operation control whereby, from detection of the trailing end of the paper sheet S by the timing sensor 15, at a predetermined switching timing estimated from the conveying speed to be sufficient for the trailing end of the paper sheet S to have at least passed the impeller 51 provided in the inlet and outlet section 35 into which the paper sheet S was introduced, the control section 5 outputs an instruction to the motor 45 to reverse the rotation direction, thereby reversing the rotation direction of the motor 45.

Figure 4:
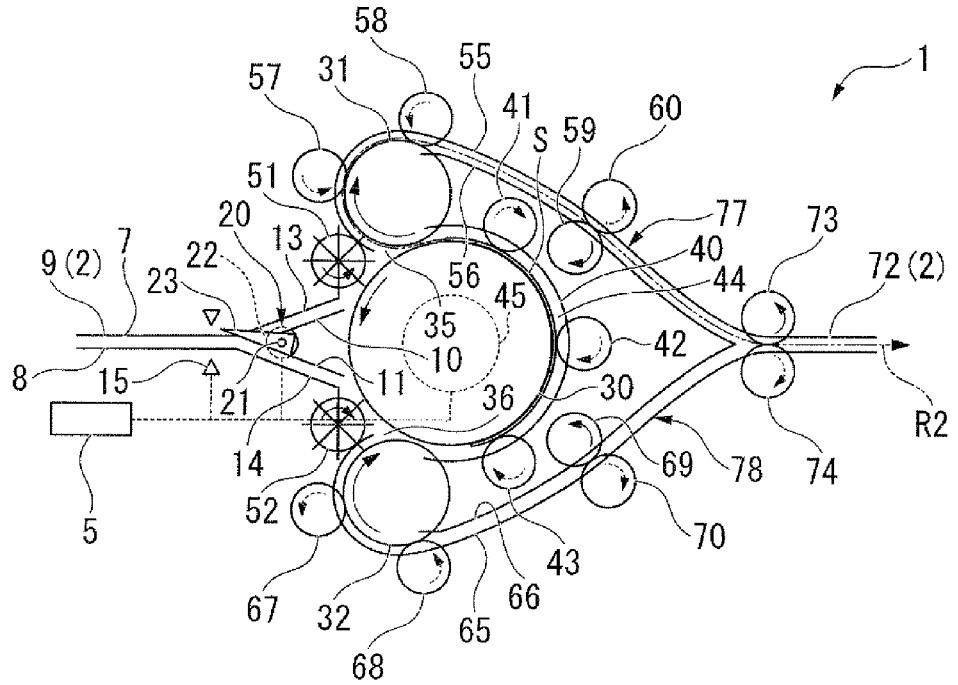
FIG. 4 is a side view of the paper sheet obverse and reverse side arranging device according to the first embodiment of the present invention, showing the rest of the first inverting conveying route R2.

This gives a state in which the base drum 30, the impeller 51, and the conveying rollers 69 and 73 rotate in the counterclockwise direction in FIG. 4, and the inlet and outlet drums 31 and 32, the impeller 52, and the conveying roller 59 rotate in the clockwise direction in FIG. 4. Accordingly, in the forward and reverse conveying path 44, the paper sheet S with guidance by the guide plate 40 is sandwiched and conveyed by the base drum 30 and the guide rollers 41 to 43 until exiting the first inlet and outlet section 35 backwards. The paper sheet S at the switchback position of this reverse operation control, has its entire length contained within the forward and reverse conveying path 44. Furthermore, the leading end of the paper sheet S which exits the inlet and outlet section 35 is separated from the base drum 30 by the impeller 51, and guided into the guide conveying path 77 between the inlet and outlet drum 31 and the guide plate 55. Whereupon, the paper sheet S, in the guide conveying path 77, with guidance by the guide plates 55 and 56, is sandwiched and conveyed by the inlet and outlet drum 31, the guide rollers 57 and 58, the conveying rollers 59 and 60, and the conveying rollers 73 and 74, until reaching the downstream conveying path 72. As a result, the paper sheet S, in the downstream conveying path 72, adopts an orientation where the obverse side is the upper side in FIG. 4 and the reverse side is the lower side in FIG. 4. By this process, the paper sheet S requiring inversion which is introduced with the sorting section 20 positioned at the first sorting position passes along the first inverting conveying route R2 indicated by the two dot chain line in FIG. 3 and FIG. 4, and is conveyed at a constant speed except during switchback when the rotation direction of the motor 45 is reversed. The switching operation control of the sorting section 20 mentioned above is performed in parallel only during this reverse operation control.

In this manner, when the succeeding paper sheet S is a paper sheet requiring inversion, and is conveyed by the inverting conveying route in contrast to the preceding paper sheet S which is conveyed by the non-inverting conveying route, a gap should be formed in the conveying direction sufficient to allow switchback of the succeeding paper sheet S after the preceding paper sheet S has separated from the inlet and outlet drum 31 or 32 serving as the exit.

The predetermined switching timing for performing reverse operation control in which an instruction is output to the motor 45 to reverse the rotation direction, is described. This switching timing, in concrete terms, is from the point in time when the trailing end of the paper sheet S has at least passed the impeller 51 provided in the inlet and outlet section 35 into which the paper sheet S was introduced, until just before the center of the paper sheet S in the conveying direction reaches the center of the forward and reverse conveying path 44 in the conveying direction, that is, timing sufficiently early to compensate for time lost by the deceleration and acceleration resulting from switchback of the motor 45. As a result, when the paper sheet S passes through the arranging device 1, the conveying speed (conveying time) of the paper sheet S along the first non-inverting conveying route R1 is the same as the conveying speed (conveying time) of the paper sheet S along the first inverting conveying route R2. The center position of the paper sheet S in the conveying direction at the switchback position of this reverse operation control is on the inlet and outlet section 35 side with respect to the central position of the conveying length of the forward and reverse conveying path 44.

Figure 5:
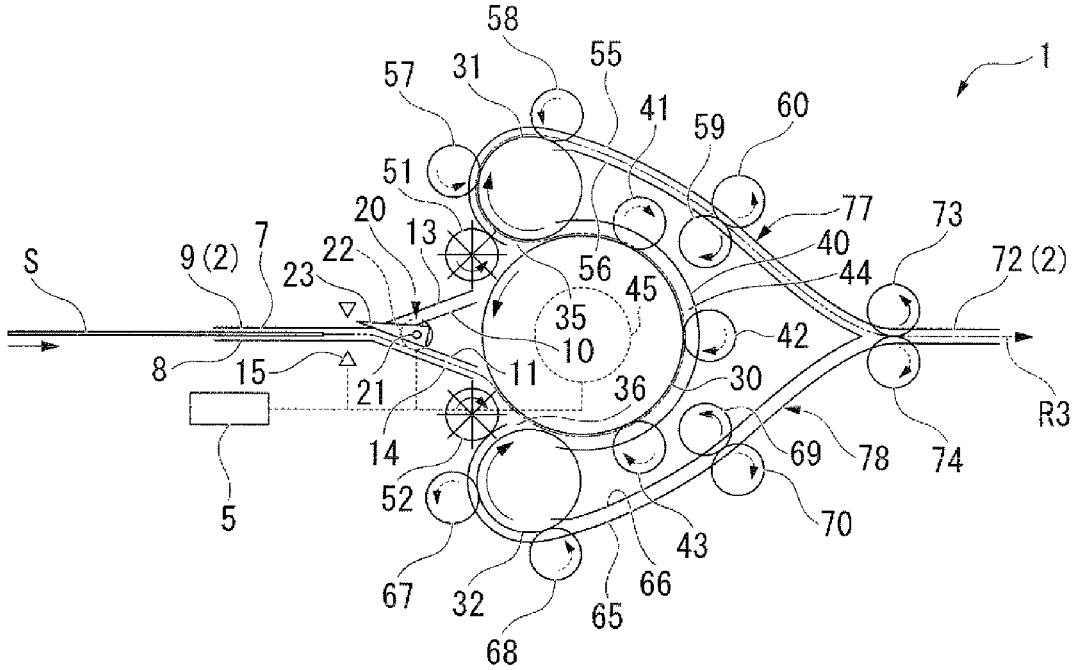
FIG. 5 is a side view of the paper sheet obverse and reverse side arranging device according to the first embodiment of the present invention, showing a second non-inverting conveying route R3.

Description will be made about a ease where it is not necessary to inverse the next paper sheet S conveyed by the upstream conveying path 9 in the arranging device 1 after the paper sheet S conveyed by the abovementioned first inverting conveying route R2. In this case, the control section 5 subjects this paper sheet S to continued operation control without performing switching operation control as mentioned above. As a result, this paper sheet S, by the sorting section 20 at the second sorting position as shown in FIG. 5, is introduced into the second inlet and outlet section 36 from the branching conveying path 14, introduced into the forward and reverse conveying path 44 by the base drum 30 and the inlet and outlet drum 32, and then with guidance by the guide plate 40 is sandwiched and conveyed in the forward and reverse conveying path 44 by the base drum 30 and the guide rollers 41 to 43 until reaching the first inlet and outlet section 35, where the leading end exits the inlet and outlet section 35. Whereupon, the leading end of the paper sheet S is separated from the base drum 30 by the impeller 51, and guided into the guide conveying path 77 between the inlet and outlet drum 31 and the guide plate 55. Then, the paper sheet S, in the guide conveying path 77, with guidance by the guide plates 55 and 56, is sandwiched and conveyed by each of the inlet and outlet drum 31, the guide rollers 57 and 58, the conveying rollers 59 and 60, and the conveying rollers 73 and 74, until reaching the downstream conveying path 72. As a result, the paper sheet S, in the downstream conveying path 72, adopts an orientation where the obverse side is the upper side in FIG. 5 and the reverse side is the lower side in FIG. 5. By this process, the paper sheet S, which is not requiring inversion and is introduced with the sorting section 20 positioned at the second sorting position, passes along the second non-inverting conveying route R3 indicated by the two dot chain line in FIG. 5 at the same constant speed as the first non-inverting conveying route R1.

When the preceding paper sheet S is a paper sheet requiring inversion and the succeeding paper sheet S is a paper sheet not requiring inversion, and the succeeding paper sheet is to be conveyed by a non-inverting conveying route in contrast to the preceding paper sheet S which is conveyed by an inverting conveying route, a gap should be formed in the conveying direction such that the preceding paper sheet S has at least undergone switchback before the succeeding paper sheet S is introduced into whichever of the inlet and outlet section 35 or 36 is selected.

Figure 6:
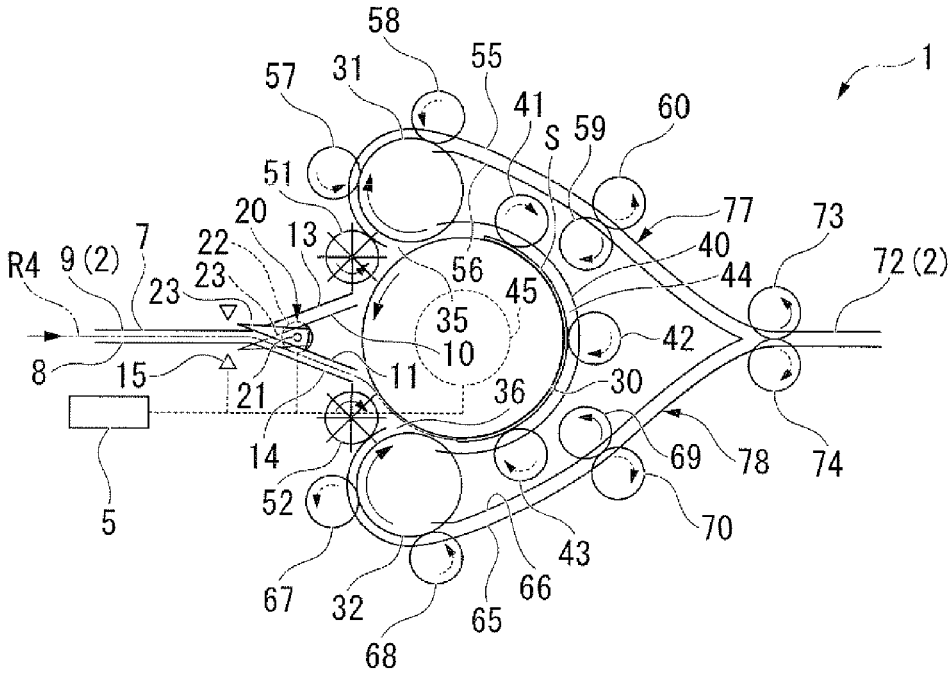
FIG. 6 is a side view of the paper sheet obverse and reverse side arranging device according to the first embodiment of the present invention, showing part of a second inverting conveying route R4.

Description will be made about a case where it is necessary to inverse the paper sheet S next conveyed by the upstream conveying path 9 in the arranging device 1 after the paper sheet S conveyed by the first inverting conveying route R2. In this case, the control section 5 performs switching operation control whereby, from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the first sorting position, and reversing the orientation of the sorting member 23 as shown by the two dot chain line in FIG. 6. This paper sheet S, by the sorting member 23 of the sorting section 20 in the second sorting position prior to switching in the state indicated by the solid line in FIG. 6, is introduced into the second inlet and outlet section 36 from the branching conveying path 14, fed into the forward and reverse conveying path 44 by the base drum 30 and the inlet and outlet drum 32, and then with the guidance of the guide plate 40 in the forward and reverse conveying path 44, is sandwiched and conveyed by the base drum 30 and the guide rollers 41 to 43 as shown in FIG. 6. In this case, the control section 5 performs reverse operation control whereby, from detection of the trailing end of the paper sheet S by the timing sensor 15, at a predetermined switching timing estimated from the conveying speed to be sufficient for the trailing end of the paper sheet S to have at least passed the impeller 52 provided in the inlet and outlet section 36 into which the paper sheet S was introduced, the control section 5 outputs an instruction to the motor 45 to reverse the rotation direction, thereby reversing the rotation direction of the motor 45.

Figure 7:
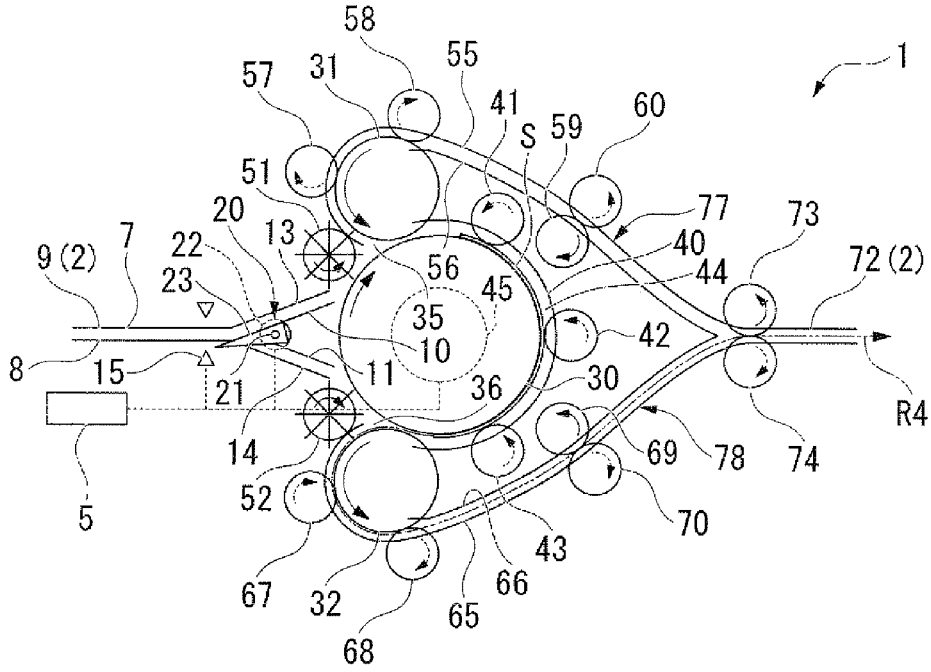
FIG. 7 is a is a side view of the paper sheet obverse and reverse side arranging device according to the first embodiment of the present invention, showing the rest of the second inverting conveying route R4.

This gives a state in which the base drum 30, the impeller 52, and the conveying roller 59 rotate in the clockwise direction in FIG. 7, and the inlet and outlet drums 31 and 32, the impeller 51, and the conveying rollers 69 and 73 rotate in the counterclockwise direction in FIG. 7. Accordingly, in the forward and reverse conveying path 44, the paper sheet S with guidance by the guide plate 40 is sandwiched and conveyed by the base drum 30 and the guide rollers 41 to 43 until exiting the inlet and outlet section 36 backwards. The paper sheet S at the switchback position of this reverse operation control, has its entire length contained within the forward and reverse conveying path 44. The leading end of the paper sheet S which exits the inlet and outlet section 36 is separated from the base drum 30 by the impeller 52, and guided into the guide conveying path 78 between the inlet and outlet drum 32 and the guide plate 65. Whereupon, the paper sheet S, in the guide conveying path 78, with guidance by the guide plates 65 and 66, is sandwiched and conveyed by the inlet and outlet drum 32, the guide rollers 67 and 68, the conveying rollers 69 and 70, and the conveying rollers 73 and 74, until reaching the downstream conveying path 72. As a result, the paper sheet S, in the downstream conveying path 72, adopts an orientation where the obverse side is the upper side in FIG. 7 and the reverse side is the lower side in FIG. 7. By this process, the paper sheet S requiring inversion which is introduced with the sorting section 20 positioned at the second sorting position passes along the second inverting conveying route R4 indicated by the two dot chain line in FIG. 6 and FIG. 7, and is conveyed at a constant speed except during switchback when the rotation direction of the motor 45 is reversed.

The predetermined switching timing for performing reverse operation control in which an instruction is output to the motor 45 to reverse the rotation direction, is described. This switching timing is also from the point in time when the trailing end of the paper sheet S has at least passed the impeller 52 provided in the inlet and outlet section 36 into which the paper sheet S was introduced, until just before the center of the paper sheet S in the conveying direction reaches the center of the forward and reverse conveying path 44 in the conveying direction, that is, timing sufficiently early to compensate for time lost by the deceleration and acceleration resulting from switchback of the motor 45. As a result, when the paper sheet S passes through the paper sheet obverse and reverse side arranging device 1, the conveying speed (conveying time) of the paper sheet S along the first inverting conveying route R2 is the same as the conveying speed (conveying time) of the paper sheet S along the second inverting conveying route R4. The center position of the paper sheet S in the conveying direction at the switchback position of this reverse operation control is on the inlet and outlet section 36 side with respect to the central position of the conveying length of the forward and reverse conveying path 44.

Unless it is necessary to inverse the next paper sheet S conveyed by the upstream conveying path 9 in the paper sheet obverse and reverse side arranging device 1 after the paper sheet S conveyed by the second non-inverting conveying route R3 shown in FIG. 5, the control section 5 also subjects this paper sheet S to continued operation control without performing switching operation control as mentioned above. As a result, this paper sheet S is also conveyed by the second non-inverting route R3 shown in FIG. 5.

Description will be made about a case where it is necessary to inverse the next paper sheet S conveyed by the upstream conveying path 9 in the arranging device 1 after the paper sheet S conveyed by the second non-inverting conveying route R3 shown in FIG. 5. In this case, the control section 5 performs switching operation control, whereby from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the first sorting position. Furthermore, the control section 5 performs reverse operation control whereby, at a predetermined switching timing estimated to be sufficient for the paper sheet S to have passed the impeller 52 provided in the inlet and outlet section 36 into which the paper sheet S was introduced, the control section 5 outputs an instruction to the motor 45 to reverse the rotation direction, thereby reversing the rotation direction of the motor 45. As a result, this paper sheet S is conveyed by the second inverting conveying route R4 shown in FIG. 6 and FIG. 7.

Unless it is necessary to inverse the next paper sheet S conveyed by the upstream conveying path 9 in the arranging device 1 after the paper sheet S conveyed by the second inverting conveying route R4 shown in FIG. 6 and FIG. 7, the control section 5 also subjects this paper sheet S to continued operation control without performing switching operation control as mentioned above. As a result, this paper sheet S is conveyed by the first non-inverting route R1 shown in FIG. 2.

Description will be made about a case where it is necessary to inverse the paper sheet S next conveyed by the upstream conveying path 9 in the arranging device 1 after the paper sheet S conveyed by the second inverting conveying route R4 shown in FIG. 6 and FIG. 7. In this case, the control section 5 performs switching operation control, whereby from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the second sorting position. Furthermore, the control section 5 performs reverse operation control whereby, at a predetermined switching timing estimated to be sufficient for the paper sheet S to have passed the impeller 51 provided in the inlet and outlet section 35 into which the paper sheet S was introduced, the control section 5 outputs an instruction to the motor 45 to reverse the rotation direction, thereby reversing the rotation direction of the motor 45. As a result, this paper sheet S is conveyed by the first inverting conveying route R2 shown in FIG. 3 and FIG. 4.

For the cases described above, that is, for a case where consecutive paper sheets S are conveyed by the first non-inverting conveying route R1, a case where a paper sheet S is conveyed by the first inverting conveying route R2 subsequent to a preceding paper sheet S being conveyed by the first non-inverting conveying route R1, a case where a paper sheet S is conveyed by the second non-inverting conveying route R3 subsequent to a preceding paper sheet S being conveyed by the first non-inverting conveying route R2, a case where a paper sheet S is conveyed by the second inverting conveying route R4 subsequent to a preceding paper sheet S being conveyed by the first inverting conveying route R2, a case where consecutive paper sheets S are conveyed by the second non-inverting conveying route R3, a case where a paper sheet S is conveyed by the second inverting conveying route R4 subsequent to a preceding paper sheet S being conveyed by the second non-inverting conveying route R3, a case where a paper sheet S is conveyed by the first non-inverting conveying route R1 subsequent to a preceding paper sheet S being conveyed by the second inverting conveying route R4, and a case where a paper sheet S is conveyed by the first inverting conveying route R2 subsequent to a preceding paper sheet S being conveyed by the second inverting conveying route R4, the conveying speed and the position of each component are set so that the interval between adjacent paper sheets S in the conveying direction does not vary. Accordingly, the paper sheets S fed from the upstream conveying path 9 into the arranging device 1 at a uniform interval and speed are always fed out from the arranging device 1 to the downstream conveying path 72 at a uniform interval and speed.

According to the first embodiment described above, when a paper sheet requiring inversion is conveyed by the upstream conveying path 9, the control section 5, by means of the sorting section 20, introduces the paper sheet requiring inversion to the base drum 30 including a rotor from either one of the inlet and outlet sections 35 and 36, and reverses the rotation direction of the base drum 30 so that the paper sheet requiring inversion is caused to exit from that inlet and outlet section 35 or 36 by the corresponding impeller 51 or 52 and guided to the downstream conveying path 72 by whichever of the guide conveying paths 77 or 78 corresponds to the impeller 51 or 52. Furthermore, when a paper sheet not requiring inversion is conveyed by the upstream conveying path 9, the control section 5, by means of the sorting section 20, introduces the paper sheet not requiring inversion to the base drum 30 from either one of the inlet and outlet sections 35 and 36, and without changing the rotation direction of the base drum 30 causes the paper sheet not requiring inversion to exit the other of the inlet and outlet sections 35 and 36 by the corresponding impeller 51 or 52, and be guided to the downstream conveying path 72 by whichever of the guide conveying paths 77 or 78 corresponds to the impeller 51 or 52. Thus, the paper sheets S present consistent obverse and reverse sides in the downstream conveying path 72. Moreover, when the rotation direction of the base drum 30 is reversed, by switching the sorting direction of the sorting section 20 to the opposite side, the next paper sheet S can be introduced to the reversed base drum 30 from the other of the inlet and outlet sections 35 and 36 after a short interval. On the other hand, when the rotation direction of the base drum 30 is not reversed, by not switching the sorting direction of the sorting section 20 to the opposite side, the next paper sheet S can be introduced to the non-reversed base drum 30 from the same inlet and outlet section 35 or 36 after a short interval. Accordingly, the feed interval of the paper sheets S (the space between notes) can be shortened thereby improving conveying efficiency. Moreover, because components which strike paper sheets requiring inversion can be eliminated, the paper sheets S can be inverted in a favorable manner without being damaged by striking.

Furthermore, because the two inlet and outlet sections 35 and 36 are disposed near each other and disposed on the sorting section 20 side of the base drum 30, sorting by means of the sorting section 20 is easier. Moreover, the two inlet and outlet sections 35 and 36 are disposed near each other, and the region on the outer peripheral surface of the base drum 30 on the distant side from the two inlet and outlet sections 35 and 36 serves as the forward and reverse conveying path 44 capable of conveying paper sheets S in either direction. Therefore during switchback whereby the paper sheet requiring inversion is introduced to the base drum 30 from either one of the inlet and outlet sections 35 and 36, and rotation direction of the base drum 30 is reversed so that the paper sheet requiring inversion is caused to exit from the inlet and outlet section 35 or 36 by the associated impeller 51 or 52, the paper sheet requiring inversion can undergo switchback in a favorable manner in the forward and reverse conveying path 44, and moreover, the scale of the base drum 30 can be reduced.

Furthermore, because the base drum 30 is configured as a circular drum, the scale of the base drum 30 can be minimized, and manufacturing costs can be minimized.

Moreover, because the paper sheet S from the base drum 30 is guided by the impellers 51 and 52, the paper sheet S can be guided away from the base drum 30 by a small and low cost mechanism. Furthermore, instead of the impellers 51 and 52, the paper sheet S may be guided by a flexible guide plate made of resin.

Moreover, in response to the sorting section 20 introducing a paper sheet requiring inversion from one of the inlet and outlet sections 35 or 36 to the base drum 30 the control section 5 performs reverse operation control by reversing rotation of the base drum 30 so that the paper sheet requiring inversion exits from that same inlet and outlet section 35 or 36. On the other hand, in response to the sorting section 20 introducing a paper sheet not requiring inversion from one of the inlet and outlet sections 35 or 36 to the base drum 30 the control section 5 performs continued operation control by not reversing rotation of the base drum 30 so that the paper sheet not requiring inversion exits from the other of the inlet and outlet sections 35 or 36. Thus, the paper sheets S present consistent obverse and reverse sides in the downstream conveying path 72. Furthermore, during reverse operation control, by switching the sorting direction of the sorting section 20 to the opposite side, the next paper sheet can be introduced to the reversed base drum 30 from the other of the inlet and outlet sections 35 or 36 after a short interval. Moreover during continued operation control, by not switching the sorting direction of the sorting section 20 to the opposite side, the next paper sheet can be introduced to the non-reversed base drum 30 from the same inlet and outlet section 35 or 36 after a short interval. Accordingly, the feed interval of the paper sheets S can be reduced, thereby improving feed efficiency.

Moreover, the control section 5, during reverse operation control, reverses rotation of the base drum 30 at a timing such that the trailing end of the paper sheet requiring inversion has at least passed the impeller 51 or 52 provided in the inlet and outlet section 35 or 36 to which the paper sheet requiring inversion was introduced. Therefore, the paper sheet requiring inversion can be reliably discharged from the same inlet and outlet section 35 or 36 into the corresponding guide conveying path 77 or 78.

Furthermore, the control section 5, during switching operation control, switches the sorting direction of the sorting section 20 to the opposite side at a timing such that the trailing end of the paper sheet requiring inversion has at least passed the sorting section 20. Therefore the sorting direction of the sorting section 20 can be switched to the opposite side without damaging the paper sheet requiring inversion.

Moreover, the two inlet and outlet sections 35 and 36 are disposed symmetrically about a line connecting the sorting section 20 and the base drum 30. Therefore the sorting section 20 applies the same sorting conditions to both of the inlet and outlet sections 35 and 36. Furthermore, the two impellers 51 and 52 and the two guide conveying paths 77 and 78 are also disposed symmetrically about a line connecting the sorting section 20 and the base drum 30. Therefore in a case where the paper sheet S is introduced from one of the inlet and outlet sections 35 or 36 and conveyed from the other of the inlet and outlet sections 35 or 36 by one of the impellers 51 or 52 and one of the guide conveying paths 77 or 78, and in a case where the paper sheet S is introduced from the other of the inlet and outlet sections 35 or 36 and conveyed from one of the inlet and outlet sections 35 or 36 by the other of the impellers 51 or 52 and the other of the guide conveying paths 77 or 78, the paper sheet S can be conveyed under the same conditions. Moreover, in a case where the paper sheet S is introduced from one of the inlet and outlet sections 35 or 36 and conveyed from that inlet and outlet section 35 or 36 by the other of the impellers 51 or 52 and the other of the guide conveying paths 77 or 78, and in a case where the paper sheet S is introduced from the other of the inlet and outlet sections 35 or 36 and conveyed from the other of the inlet and outlet sections 35 or 36 by one of the impellers 51 or 52 and one of the guide conveying paths 77 or 78, the paper sheet S can be conveyed under the same conditions. Accordingly, the control by the control section 5 is simplified.

Furthermore, in response to the sorting section 20 introducing a paper sheet requiring inversion from one of the inlet and outlet sections 35 and 36 to the base drum 30, the control section 5, immediately prior to when the central region of the paper sheet requiring inversion in the conveying direction reaches the central region of the forward and reverse conveying path 44 in the conveying direction, performs reverse operation control by supplying an instruction to the base drum 30 to reverse the rotation of the base drum 30 so that the paper sheet requiring inversion exits from that same inlet and outlet section 35 or 36. On the other hand, in response to the sorting section 20 introducing a paper sheet not requiring inversion from one of the inlet and outlet sections 35 and 36 to the base drum 30 the control section 5 performs continued operation control by not reversing rotation of the base drum 30 so that the paper sheet not requiring inversion exits from the other of the inlet and outlet sections 35 and 36. By this process, the delay resulting from the time lag caused by the reversal can be suppressed, and paper sheets requiring inversion and paper sheets not requiring inversion can be fed to the downstream conveying path 72 with the same timing from the time of sorting.

In response to the sorting section 20 introducing a paper sheet requiring inversion from either one of the inlet and outlet sections 35 and 36 to the base drum 30, the control section 5, at the point when the central region of the paper sheet requiring inversion in the conveying direction reaches the central region of the forward and reverse conveying path 44 in the conveying direction, performs reverse operation control by supplying an instruction to reverse rotation of the base drum 30 so that the paper sheet requiring inversion exits from that same inlet and outlet section 35 or 36. By performing control this way, by simple control, paper sheets requiring inversion and paper sheets not requiring inversion can be fed to the downstream conveying path 72 with substantially the same timing from the time of sorting.

As mentioned above, if the conveying length of the forward and reverse conveying path 44 between the inlet and outlet sections 35 and 36 is longer than the length in the conveying direction of the paper sheet S to be conveyed, the paper sheet S at the switchback position of reverse operation control can be accommodated over its entire length within the forward and reverse conveying path 44. In cases where the conveying length of the forward and reverse conveying path 44 is shortened to achieve further size reductions, the paper sheet S at the switchback position of reverse operation control, may pass the introduction side of impeller 51 or 52 so that the end protrudes out from the introduction side of inlet and outlet section 35 or 36.

A paper sheet obverse and reverse side arranging device according to a second embodiment of the present invention is described with reference to FIG. 8 to FIG. 14, focusing on the differences from the paper sheet obverse and reverse side arranging device according to the first embodiment.

Figure 8:
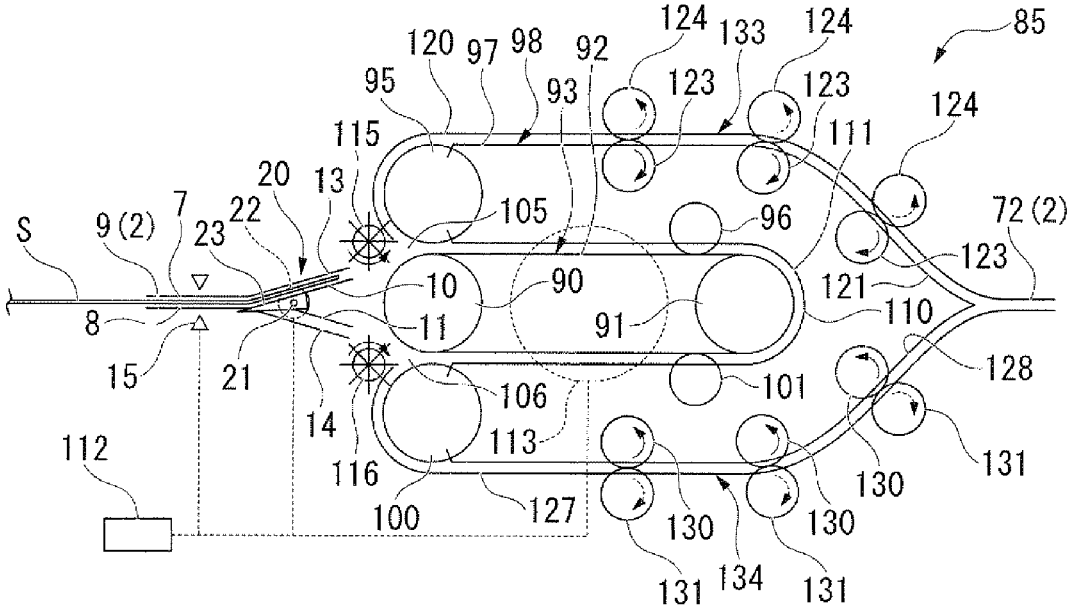
FIG. 8 is a side view showing a paper sheet obverse and reverse side arranging device according to a second embodiment of the present invention.

As shown in FIG. 8, a paper sheet obverse and reverse side arranging device (also simply referred to as the "arranging device" below) 85 includes a pulley 90, a pulley 91, and a conveyor belt 92. The pulley 90 is disposed at the end position of the branching conveying paths 13 and 14 which branch from the upstream conveying path 9. The pulley 91 has the same diameter as the pulley 90, and is disposed on the downstream conveying path 72 side of the pulley 90. The conveyor belt 92 is endless belt, and spans between the pulleys 90 and 91 serving as a rotatable rotation body. The conveyor belt 92 and the pulleys 90 and 91 constitute a belt conveyor (reversible conveying section) 93. The pivoting shaft 21 of the sorting section 20, the pulley 90, and the pulley 91 are disposed in a collinear manner, and upon a line connecting these components, the upstream conveying path 9 and the downstream conveying path 72 are also provided.

On one side of the pulley 90 in a direction orthogonal to the length direction of the belt conveyer 93, a conveying roller 95 with the same diameter as the pulley 90 is provided. On one side of the pulley 91 in the same direction, a conveying roller 96 with a smaller diameter than the conveying roller 95 is provided.

On the other side of the pulley 90 in a direction orthogonal to the length direction of the belt conveyer 93, a conveying roller 100 with the same diameter as the pulley 90 is provided. On the other side of the pulley 91 in the same direction, a conveying roller 101 with a smaller diameter than the conveying roller 100 is provided. A guide plate 110 is provided on the outward portion of the conveyor belt 92 provided at the two straight portions of the belt conveyer 93 and around the curved portion which follows the pulley 91. The guide plate 110 is U-shaped, that is, a combination of straight lines and a curved shape. The guide plate 110, together with the conveyor belt 92 of the belt conveyer 93, sandwiches the paper sheet S to guide the conveying of the paper sheet S by the conveyor belt 92.

The space between the belt conveyer 93 and the first conveying roller 95 on the branching conveying path 13 side is a first inlet and outlet section 105 which introduces the paper sheets S sorted to the branching conveying path 13 side by the sorting section 20, to the space between the belt conveyer 93 and the first conveying roller 95. The space between the belt conveyer 93 and the second conveying roller 100 on the branching conveying path 14 side is a second inlet and outlet section 106 which introduces the paper sheets S sorted to the branching conveying path 14 side by the sorting section 20, to the space between the belt conveyer 93 and the second conveying roller 100. In other words, the sorting section 20 provided in the upstream conveying path 9 upstream from the belt conveyer 93 sorts the paper sheets S among the two inlet and outlet sections 105 and 106 of the belt conveyer 93 provided for separate conveying directions. By this configuration, the two inlet and outlet sections 105 and 106 are disposed in close proximity to each other around the circumferential direction of the belt conveyer 93. The two inlet and outlet sections 105 and 106 are disposed symmetrically about a line connecting the sorting section 20 and the belt conveyer 93, that is, a line connecting the center of the pivoting shaft 21 and the centers of the pulleys 90 and 91 of the belt conveyer 93. The two branching conveying paths 13 and 14 which guide the paper sheet S into these two inlet and outlet sections 105 and 106 are also disposed symmetrically about a line connecting the sorting section 20 and the belt conveyer 93.

The region on the outer peripheral surface of the conveyor belt 92 of the belt conveyer 93 between the inlet and outlet sections 105 and 106 on the distant side, which is opposite from the sorting section 20 side, together with the guide plate 110, and the conveying rollers 96 and 101 constitutes a forward and reverse conveying path 111 which conveys the paper sheet S. This region on distance side may indicate a region which connects the two inlet and outlet sections 105 and 106 to each other along the peripheral direction of the conveyor belt 92, and length of which may be more than the half of the total circumference of the conveyor belt 92. This forward and reverse conveying path 111 has a peripheral length equal to or longer than the entire length in the conveying direction of the paper sheet S. The belt conveyer 93 is driven by a reversible motor 113 controlled by a control section 112 at a predetermined reduction ratio which is constant with respect to this motor 113, enabling the paper sheet S to be conveyed in a reversible manner. The conveying rollers 95 and 100 are driven by the motor 113 at a predetermined reduction ratio which is constant with respect to this motor 113 and move in the opposite direction from the belt conveyer 93. The forward and reverse conveying path 111 also forms a symmetrical shape about a line connecting the sorting section 20 and the belt conveyer 93.

In the first inlet and outlet section 105, an impeller (guide section) 115 is provided which separates the paper sheet S, fed out from the forward and reverse conveying path 111 via the inlet and outlet section 105, from the belt conveyer 93, and guides the paper sheet S to the conveying roller 95 side. On the second inlet and outlet section 106, an impeller (guide section) 116 is provided which separates the paper sheet S, fed out from the forward and reverse conveying path 111 via the inlet and outlet section 106, from the belt conveyer 93, and guides the paper sheet S to the conveying roller 100 side. These two impellers 115 and 116 are disposed symmetrically about a line connecting the sorting section 20 and the belt conveyer 93. The impellers 115 and 116 are driven by a different motor (not shown) from the motor 113 at a predetermined reduction ratio which is constant with respect to this motor. The impeller 115 is constantly driven in such a direction that the inlet and outlet section 105 side thereof moves from the belt conveyer 93 side towards the conveying roller 95 side (counterclockwise in FIG. 8). The impeller 116 is driven in such a direction that the inlet and outlet section 106 side thereof moves from the belt conveyer 93 towards the conveying roller 100 side (clockwise in FIG. 8).

On the inlet and outlet section 105 side of the first conveying roller 95 and on the opposite side to the belt conveyer 93 side, a first guide plate 120 is provided. The guide plate 120, together with the conveying roller 95, sandwiches the paper sheet S and guides the conveyance of the paper sheet S. This guide plate 120 extends further from the section space apart from the conveying roller 95 in a direction away from the upstream conveying path 9. Moreover, on the belt conveyer 93 side of the guide plate 120, a guide plate 121 is provided with a predetermined space apart from the guide plate 120. Furthermore, at the center position in the extending direction of the guide plate 120 and the guide plate 121, a plurality of pairs of conveying rollers 123 and 124 capable of contacting each other are provided. The conveying rollers 123 and 124 are disposed in openings (not shown) in the guide plates 120 and 121. The conveying roller 123 is driven by a different motor (not shown) from the motor 113 at a predetermined reduction ratio which is constant with respect to this motor. The conveying roller 123 rotates in such a direction that the conveying roller 124 side moves away from the upstream conveying path 9 (clockwise in FIG. 8). The conveying roller 124, by contact with the conveying roller 123 or the paper sheet S against the conveying roller 123, co-rotates with the conveying roller 123.

On the inlet and outlet section 106 side of the second conveying roller 100 and the opposite side to the belt conveyer 93 side, a second guide plate 127 is provided. The guide plate 127, together with the conveying roller 100, sandwiches the paper sheet S and guides the conveyance of the paper sheet S. This guide plate 127 extends further from the section space apart from the conveying roller 100 in a direction away from the upstream conveying path 9. Moreover, on the belt conveyer 93 side of the guide plate 127, a guide plate 128 is provided with a predetermined space apart from the guide plate 127. Furthermore, at the center position in the extending direction of the guide plate 127 and the guide plate 128, a plurality of pairs of conveying rollers 130 and 131 capable of contacting each other are provided. The conveying rollers 130 and 131 are disposed in openings (not shown) in the guide plates 127 and 128. The conveying roller 130 is driven by a different motor (not shown) from the motor 113 at a predetermined reduction ratio which is constant with respect to this motor. The conveying roller 130 rotates in such a direction that the conveying roller 131 side moves away from the upstream conveying path 9 (counterclockwise in FIG. 8). The conveying roller 131, by contact with the conveying roller 130 or the paper sheet S against the conveying roller 130, co-rotates with the conveying roller 130.

The ends of the guide plates 121 and 128 on the opposite side to the upstream conveying path 9 side are connected to each other. The ends of the guide plates 120 and 127 on the opposite side to the upstream conveying path 9 side are parallel to each other, and constitute the downstream conveying path 72. The impellers 115 and 116 and the conveying rollers 123 and 130 whose rotation directions are always constant are driven by a common motor.

The conveying roller 95, the guide plates 120 and 121 and the conveying rollers 123 and 124 constitute a guide conveying path (guide conveying section) 133. The guide conveying path 133 conveys the paper sheet S, which exits the inlet and outlet section 105 and is separated from the belt conveyer 93 by the impeller 115, towards the downstream conveying path 72 located downstream. The conveying roller 100, the guide plates 127 and 128, and the conveying rollers 130 and 131 constitute a guide conveying path (guide conveying section) 134. The guide conveying path 134 conveys the paper sheet 5, which exits the second inlet and outlet section 106 and is separated from the belt conveyer 93 by the impeller 116, towards the downstream conveying path 72 located downstream. These two guide conveying paths 133 and 134 form a symmetrical shape about a line connecting the sorting section 20 and the belt conveyer 93.

Next, the operation of the paper sheet obverse and reverse side arranging device 85 of the second embodiment with the above construction is described together with details of the control performed by the control section 112.

Figure 9:
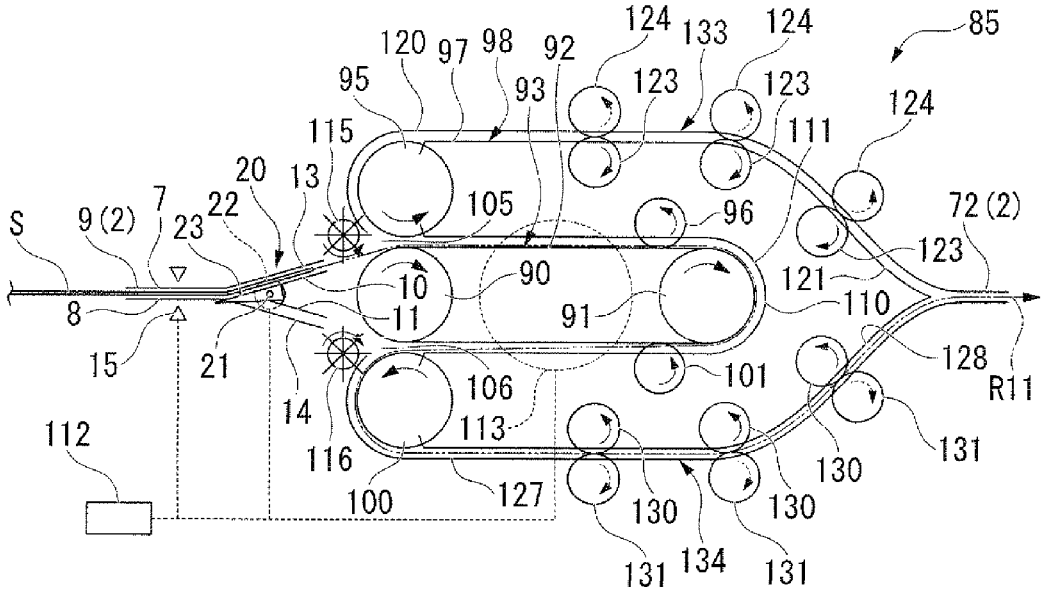
FIG. 9 is a side view of the paper sheet obverse and reverse side arranging device according to the second embodiment of the present invention, showing a first non-inverting conveying route R11.

The arranging device 85 causes the paper sheets S conveyed from the upstream conveying path 9 to be in a condition where their obverse and reverse side directions face in a uniform direction (i.e., orientations of the paper sheets S in the thickness direction are the same to each other) in the downstream conveying path 72. As an example, a case of arranging paper sheets S so that the obverse side in the figures of the downstream conveying path 72 is the upper side of the paper sheet S and the reverse side in the figures of the downstream conveying path 72 is the lower side of the paper sheet S, is described. As shown in FIG. 9, when the sorting section 20 is positioned at a first sorting position, the belt conveyer 93, the impeller 116, and the conveying roller 123 rotate in the clockwise direction in FIG. 9, and the conveying rollers 95 and 100, the impeller 115, and the conveying roller 130 rotate in the counterclockwise direction in FIG. 9. Furthermore, the conveying rollers 124 and 131 each co-rotate by contact with their respective counterparts.

In the state shown in FIG. 9, when the paper sheet S is conveyed from the upstream conveying path 9, the control section 112, from the identification results of the identification section on the upstream side (not shown), if this paper sheet S is a paper sheet not requiring inversion having an inversion not required orientation where the obverse side is the upper side in FIG. 9 and the reverse side is the lower side in FIG. 9, does not perform switching operation control to switch the sorting direction of the sorting section 20 to the opposite side even after the timing sensor 15 detects the trailing end of the paper sheet S. This paper sheet S, by the sorting member 23 of the sorting section 20 in the first sorting position as shown in FIG. 9, is introduced from the branching conveying path 13 into the first inlet and outlet section 105, and then fed between the belt conveyer 93 and conveying roller 95 of the forward and reverse conveying path 111. In this case, the control section 112, because this paper sheet S is a paper sheet not requiring inversion, performs continued operation control whereby the paper sheet S exits as is from the second inlet and outlet section 106, by not reversing the rotation of the motor 113, that is, the belt conveyer 93 and the inlet and conveying rollers 95 and 100. As a result, the paper sheet S, in the forward and reverse conveying path 111, is sandwiched and conveyed by the belt conveyer 93 and the guide plate 110, then from midstream is sandwiched and conveyed by the belt conveyer 93 and the conveying rollers 96 and 101, until reaching the second inlet and outlet section 106 where the leading end exits from the inlet and outlet section 106. Whereupon, the impeller 116 separates the leading end of the paper sheet S from the belt conveyer 93, and guides the paper sheet S between the conveying roller 100 and the guide plate 127 and into the guide conveying path 134 between the guide plates 127 and 128. The paper sheet S, in the guide conveying path 134, with guidance by the guide plates 127 and 128, is from midstream sandwiched and conveyed by the conveying rollers 130 and 131 until reaching the downstream conveying path 72. As a result, the paper sheet S, in the downstream conveying path 72, is orientated with the obverse side upward in FIG. 9 and the reverse side downward in FIG. 9. By this process, the paper sheet S, which is a paper sheet not requiring inversion introduced with the sorting section 20 positioned at the first sorting position, is conveyed at a constant speed along the first non-inverting conveying route R11 shown by the two dot chain line in FIG. 9.

Unless it is also necessary to inverse the next paper sheet S conveyed by the upstream conveying path 9 in the arranging device 85 after the paper sheet S conveyed by the first non-inverting conveying route R11, the control section 112 also subjects this paper sheet S to continued operation control without performing switching operation control as mentioned above. As a result, the paper sheet S is conveyed along the first non-inverting conveying route R11.

In this manner, when the preceding paper sheet S and succeeding paper sheet S both do not require inversion, and the succeeding paper sheet S is conveyed by the same non-inverting conveying route as the preceding paper sheet S, a gap should be limited in the conveying direction sufficient that the adjacent paper sheets S do not interfere with each other.

Figure 10:
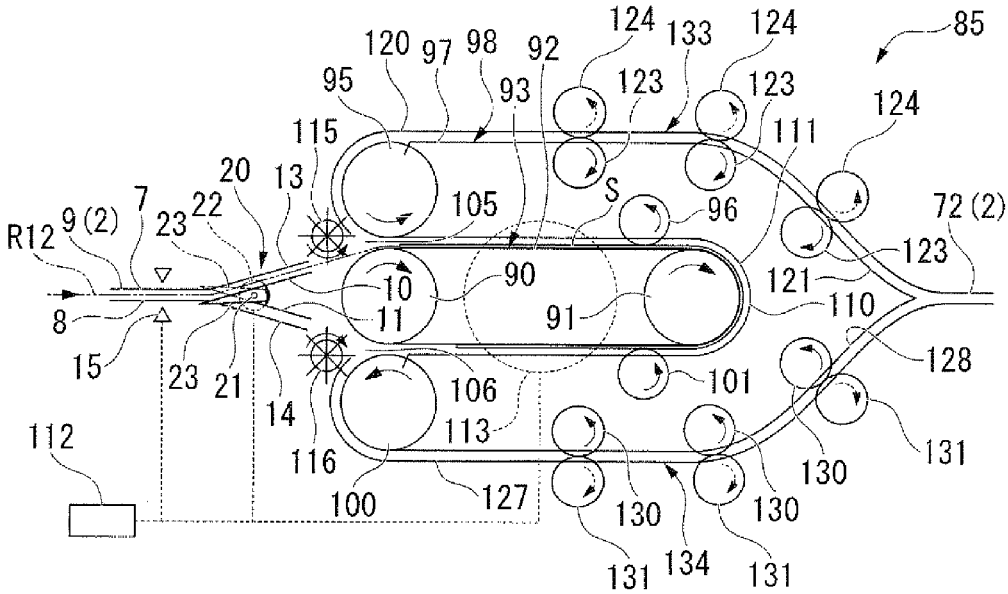
FIG. 10 is a side view of the paper sheet obverse and reverse side arranging device according to the second embodiment of the present invention, showing part of a first inverting conveying route R12.

Description will be made about a case where it is necessary to inverse the paper sheet S next conveyed by the upstream conveying path 9 in the arranging device 85 after the paper sheet S conveyed by the first non-inverting conveying route R11 because of an orientation where the obverse side is the lower side in FIG. 10 and the reverse side is the upper side in FIG. 10, for example. In this case, the control section 112 performs switching operation control, whereby from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the second sorting position, and reversing the orientation of the sorting member 23 as shown by the two dot chain line in FIG. 10. This paper sheet S, by the sorting member 23 of the sorting section 20 in the first sorting position prior to switching in the state indicated by the solid line in FIG. 10, is introduced into the first inlet and outlet section 105 from the branching conveying path 13, and as shown in FIG. 10, in the forward and reverse conveying path 111, is sandwiched and conveyed by the belt conveyer 93 and the guide plate 110, then from midstream is sandwiched and conveyed by the belt conveyer 93 and the conveying rollers 96 and 101. In this case, the control section performs reverse operation control whereby, from detection of the trailing end of the paper sheet S by the timing sensor 15, at a predetermined switching timing estimated from the conveying speed to be sufficient for the trailing end of the paper sheet S to have at least passed the impeller 115 provided in the inlet and outlet section 105 into which the paper sheet S was introduced, the control section 112 outputs an instruction to the motor 113 to reverse the rotation direction, thereby reversing the rotation direction of the motor 113.

Figure 11:
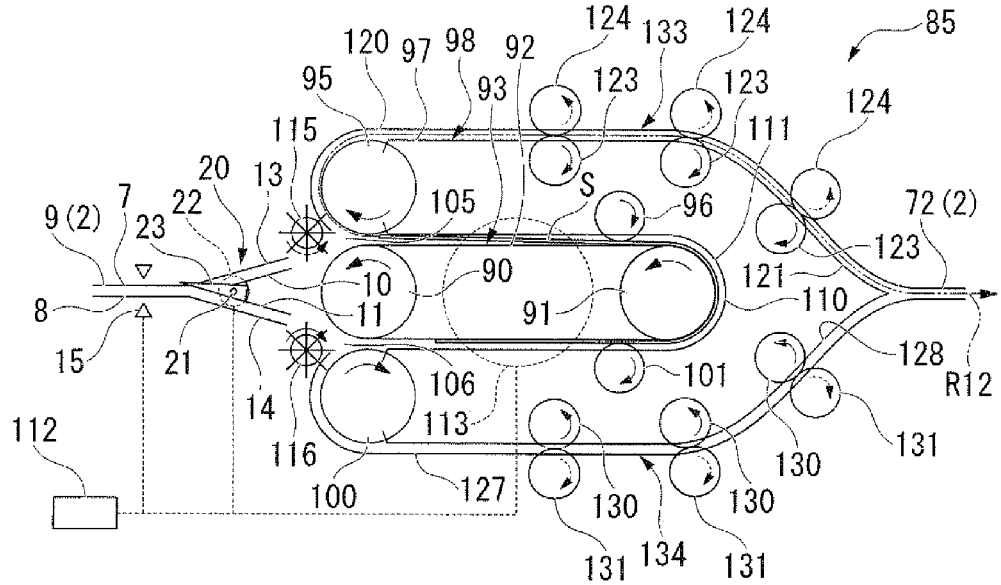
FIG. 11 is a is a side view of the paper sheet obverse and reverse side arranging device according to the second embodiment of the present invention, showing the rest of the first inverting conveying route R12.

This gives a state in which the belt conveyer 93, the impeller 115, and the conveying rollers 130 rotate in the counterclockwise direction in FIG. 11, and the conveying rollers 95 and 100, the impeller 116, and the conveying rollers 123 rotate in the clockwise direction in FIG. 11. Accordingly, in the forward and reverse conveying path 111, the paper sheet S sandwiched by the belt conveyer 93, the conveying roller 95, the guide plate 110, and the conveying rollers 96 and 101 is conveyed by these components until exiting the inlet and outlet section 105 backwards. The leading end of the paper sheet S which exits the inlet and outlet section 105 is separated from the belt conveyer 93 by the impeller 115, and guided into the guide conveying path 133 between the conveying roller 95 and the guide plate 120. Whereupon, the paper sheet S, in the guide conveying path 133, with guidance by the guide plates 120 and 121, is sandwiched and conveyed by the plurality of pairs of conveying rollers 123 and 124, until reaching the downstream conveying path 72. As a result, the paper sheet S, in the downstream conveying path 72, adopts an orientation where the obverse side is the upper side in FIG. 11 and the reverse side is the lower side in FIG. 11. By this process, the paper sheet S requiring inversion which is introduced with the sorting section 20 positioned at the first sorting position passes along the first inverting conveying route R12 indicated by the two dot chain line in FIG. 10 and FIG. 11, and is conveyed at a constant speed except during switchback when the rotation direction of the motor 113 is reversed. The switching operation control of the sorting section 20 mentioned above is performed in parallel only during this reverse operation control.

In this manner when the succeeding paper sheet S is a paper sheet requiring inversion, and is conveyed by the inverting conveying route in contrast to the preceding paper sheet S which is conveyed by the non-inverting conveying route, a gap should be formed in the conveying direction sufficient to allow switchback of the succeeding paper sheet S after the preceding paper sheet S has separated from the corresponding conveying roller 95 or 100.

The predetermined switching timing for performing reverse operation control in which an instruction is output to the motor 113 to reverse the rotation direction, is described. This switching timing is from the point in time when the trailing end of the paper sheet S has at least passed the impeller 115 provided in the inlet and outlet section 105 into which the paper sheet S was introduced, until just before the center of the paper sheet S in the conveying direction reaches the center of the forward and reverse conveying path 111 in the conveying direction, that is, timing sufficiently early to compensate for time lost by the deceleration and acceleration resulting from switchback of the motor 113. As a result, when passing through the arranging device 85, the conveying speed (conveying time) of the paper sheet S along the first non-inverting conveying route R11 is the same as the conveying speed (conveying time) of the paper sheet S along the first inverting conveying route R12.

Figure 12:
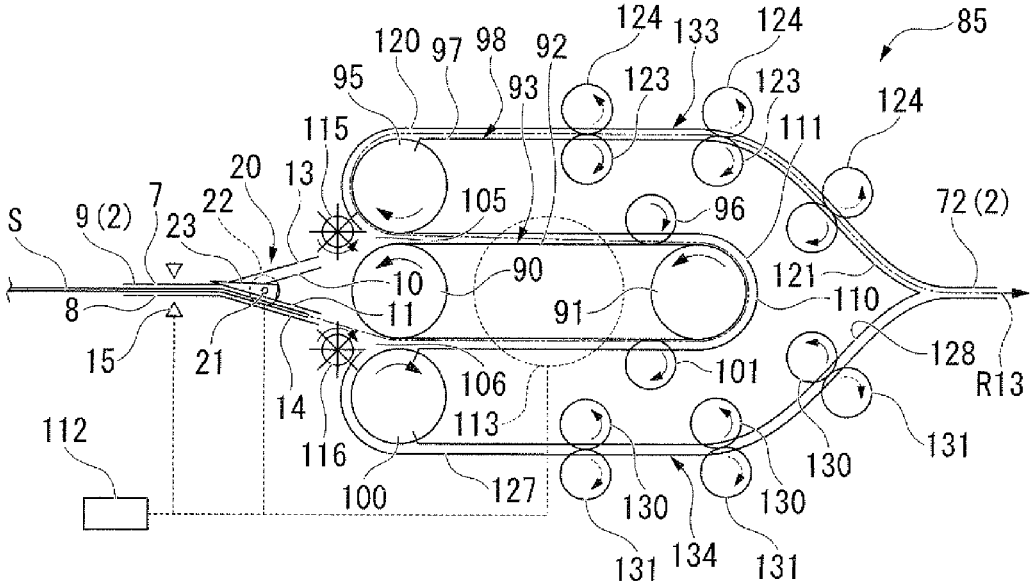
FIG. 12 is a side view of the paper sheet obverse and reverse side arranging device according to the second embodiment of the present invention, showing a second non-inverting conveying route R13.

Description will be made about a case where it is necessary to inverse the next paper sheet S conveyed by the upstream conveying path 9 in the arranging device 85 after the paper sheet S conveyed by the abovementioned first inverting conveying route R12. In this case, the control section 112 subjects this paper sheet S to continued operation control without performing switching operation control as mentioned above. As a result, the paper sheet S, by the sorting section 20 at the second sorting position as shown in FIG. 12, is introduced into the second inlet and outlet section 106 from the branching conveying path 14, and fed between the conveying roller 100 and the belt conveyer 93 of the forward and reverse conveying path 111. The paper sheet S, in the forward and reverse conveying path 111, is sandwiched and conveyed by the belt conveyer 93 and the guide plate 110, then from midstream is sandwiched and conveyed by the belt conveyer 93 and the conveying rollers 96 and 101, until reaching the first inlet and outlet section 105, where the leading end exits the inlet and outlet section 105. Whereupon, the leading end of the paper sheet S is separated from the belt conveyer 93 by the impeller 115, and guided between the conveying roller 95 and the guide plate 120 and into the guide conveying path 133 between the guide plates 120 and 121. The paper sheet S, in the guide conveying path 133, with guidance by the guide plates 120 and 121, is sandwiched and conveyed from midstream by the conveying rollers 123 and 124 until reaching the downstream conveying path 72. As a result, the paper sheet S, in the downstream conveying path 72, adopts an orientation where the obverse side is the upper side in FIG. 12 and the reverse side is the lower side in FIG. 12. By this process, the paper sheet S not requiring inversion which is introduced with the sorting section 20 positioned at the second sorting position passes along the second non-inverting conveying route R13 indicated by the two dot chain line in FIG. 12 at the same constant speed as the first non-inverting conveying route R11.

When the preceding paper sheet S is a paper sheet requiring inversion and the succeeding paper sheet S is a paper sheet not requiring inversion, and the succeeding paper sheet is to be conveyed by a non-inverting conveying route in contrast to the preceding paper sheet S which is conveyed by an inverting conveying route, a gap should be formed in the conveying direction such that the preceding paper sheet S has at least undergone switchback before the succeeding paper sheet S is introduced into whichever of the inlet and outlet section 105 or 106 is selected.

Figure 13:
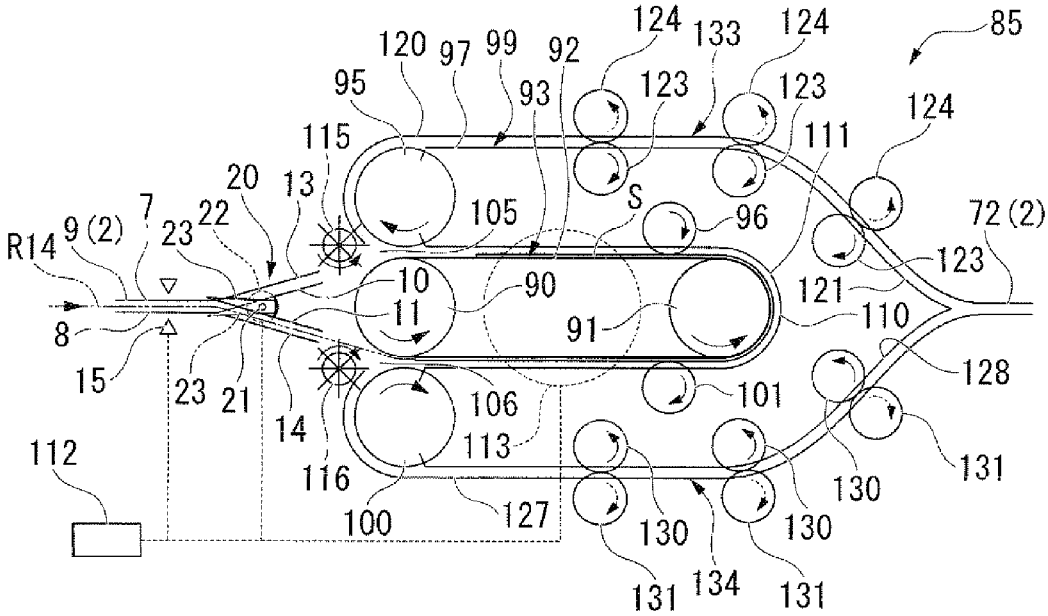
FIG. 13 is a side view of the paper sheet obverse and reverse side arranging device according to the second embodiment of the present invention, showing part of a second inverting conveying route R14.

Description will be made about a case where the paper sheet S next conveyed by the upstream conveying path 9 in the arranging device 85 after the paper sheet S conveyed by the first inverting conveying route R12 is a paper sheet requiring inversion. In this case, the control section 112 performs switching operation control whereby, from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the first sorting position, and reversing the orientation of the sorting member 23 as shown by the two dot chain line in FIG. 13. This paper sheet S, by the sorting member 23 of the sorting section 20 in the second sorting position prior to switching as indicated by the solid line in FIG. 13, is introduced into the second inlet and outlet section 106 from the branching conveying path 14, fed between the conveying roller 100 and the belt conveyer 93 of the forward and reverse conveying path 111, and then in the forward and reverse conveying path 111, is sandwiched and conveyed by the belt conveyer 93 and the guide plate 110, then from midstream is sandwiched and conveyed by the belt conveyer 93 and the conveying rollers 96 and 101. In this case, the control section 112 performs reverse operation control whereby, from detection of the trailing end of the paper S by the timing sensor 15, at a predetermined switching timing estimated from the conveying speed to be sufficient for the trailing end of the paper sheet S to have at least passed the impeller 116 provided in the inlet and outlet section 106 into which the paper sheet was introduced, the control section 112 outputs an instruction to the motor 113 to reverse the rotation direction, thereby reversing the rotation direction of the motor 113.

Figure 14:
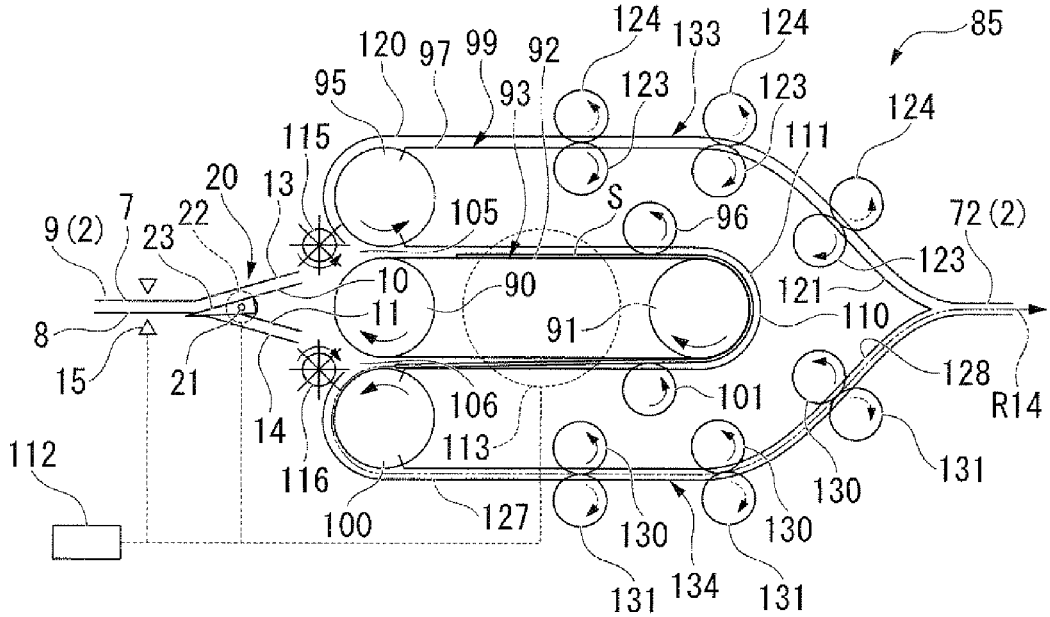
FIG. 14 is a is a side view of the paper sheet obverse and reverse side arranging device according to the second embodiment of the present invention, showing the rest of the second inverting conveying route R14.

This gives a state in which the belt conveyer 93, the impeller 116, and the conveying roller 123 rotate in the clockwise direction in FIG. 14, and the conveying rollers 95 and 100, the impeller 115, and the conveying rollers 130 rotate in the counterclockwise direction in FIG. 14. Accordingly, in the forward and reverse conveying path 111, the paper sheet S is sandwiched, and conveyed, by the belt conveyer 93, the conveying roller 95, the guide plate 110, and the conveying rollers 96 and 101, and then exits backwards from the inlet and outlet section 106. The leading end of the paper sheet S which exits the inlet and outlet section 106 is separated from the belt conveyer 93 by the impeller 116, and guided into the guide conveying path 134 between the conveying roller 100 and the guide plate 127. Whereupon, the paper sheet S, in the guide conveying path 134, with guidance by the guide plates 127 and 128, is sandwiched and conveyed by the plurality of pairs of conveying rollers 130 and 131, until reaching the downstream conveying path 72. As a result, the paper sheet S, in the downstream conveying path 72, adopts an orientation where the obverse side is the upper side in FIG. 14 and the reverse side is the lower side in FIG. 14. By this process, the paper sheet S requiring inversion, which is introduced with the sorting section 20 positioned at the second sorting position, passes along the second inverting conveying route R14 indicated by the two dot chain line in FIG. 13 and FIG. 14 and is conveyed at a constant speed except during switchback when the rotation direction of the motor 113 is reversed.

The predetermined switching timing for performing reverse operation control in which an instruction is output to the motor 113 to reverse the rotation direction, is described. This switching timing is also from the point in time when the trailing end of the paper sheet S has at least passed the impeller 116 provided in the inlet and outlet section 106 into which the paper sheet S was introduced until just before the center of the paper sheet S in the conveying direction reaches the center of the forward and reverse conveying path 111 in the conveying direction, that is, timing sufficiently early to compensate for time lost by the deceleration and acceleration resulting from switchback of the motor 113. As a result, when the paper sheet S passes through the arranging device 85, the conveying speed (conveying time) of the paper sheet S along the first inverting conveying route R12 is the same as the conveying speed (conveying time) of the paper sheet S along the second inverting conveying route R14.

If the next paper sheet S conveyed by the upstream conveying path 9 in the arranging device 85 after the paper sheet S conveyed by the second non-inverting conveying route R13 shown in FIG. 12 is a paper sheet not requiring inversion, the control section 112 also subjects this paper sheet S to continued operation control without performing switching operation control as mentioned above. As a result, this paper sheet S is also conveyed by the second non-inverting route R13 shown in FIG. 12.

A case where the next paper sheet S conveyed by the upstream conveying path 9 in the arranging device 85 after the paper sheet S conveyed by the second non-inverting conveying route R13 shown in FIG. 12 is a paper sheet requiring inversion is described. In this case, the control section 112 performs switching operation control, whereby from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the first sorting position. Furthermore, the control section 112 performs reverse operation control whereby, at a predetermined switching timing estimated to be sufficient for the paper sheet S to have passed the impeller 116 provided in the inlet and outlet section 106 into which the paper sheet S was introduced, the control section 112 outputs an instruction to the motor 113 to reverse the rotation direction, thereby reversing the rotation direction of the motor 113. As a result, this paper sheet S is conveyed by the second inverting conveying route R14 shown in FIG. 13 and FIG. 14.

Unless it is necessary to inverse the next paper sheet 9 conveyed by the upstream conveying path 9 in the arranging device 1 after the paper sheet conveyed by the second inverting conveying route R14 shown in FIG. 13 and FIG. 14, the control section 112 also subjects this paper sheet S to continued operation control without performing switching operation control as mentioned above. As a result, this paper sheet S is conveyed by the first non-inverting route R11 shown in FIG. 9.

Description will be made about a case where it is necessary to inverse the paper sheet S next conveyed by the upstream conveying path 9 in the arranging device 85 after the paper sheet S conveyed by the second inverting conveying route R14 shown in FIG. 13 and FIG. 14. In this case, the control section 112 performs switching operation control, whereby from detection of the trailing end of the paper sheet S by the timing sensor 15, the sorting drive section 22 is driven at a predetermined timing estimated based on the conveying speed to be sufficient for the trailing end of the paper sheet S to have at least passed the sorting section 20, thereby switching the sorting direction of the sorting section 20 to the opposite side, that is, the second sorting position. Furthermore, the control section 112 performs reverse operation control whereby, at a predetermined switching timing estimated to be sufficient for the paper sheet S to have passed the impeller 115 provided in the inlet and outlet section 105 into which the paper sheet S was introduced, the control section 112 outputs an instruction to the motor 113 to reverse the rotation direction, thereby reversing the rotation direction of the motor 113. As a result, this paper sheet S is conveyed by the first inverting conveying route R12 shown in FIG. 10 and FIG. 11.

For the cases described above, that is, for a case where consecutive paper sheets S are conveyed by the first non-inverting conveying route R11, a case where a paper sheet S is conveyed by the first inverting conveying route R12 subsequent to a preceding paper sheet S being conveyed by the first non-inverting conveying route R11, a case where a paper sheet S is conveyed by the second non-inverting conveying route R13 subsequent to a preceding paper sheet S being conveyed by the first inverting conveying route R12, a case where a paper sheet S is conveyed by the second inverting conveying route R14 subsequent to a preceding paper sheet S being conveyed by the first inverting conveying route R12, a case where consecutive paper sheets S are conveyed by the second non-inverting conveying route R13, a case where a paper sheet S is conveyed by the second inverting conveying route R14 subsequent to a preceding paper sheet S being conveyed by the second non-inverting conveying route R13, a case where a paper sheet S is conveyed by the first non-inverting conveying route R11 subsequent to a preceding paper sheet S being conveyed by the second inverting conveying route R14, and a case where a paper sheet S is conveyed by the first inverting conveying route R12 subsequent to a preceding paper sheet S being conveyed by the second inverting conveying route R14, the conveying speed and the position of each component are set so that the interval between adjacent paper sheets S in the conveying direction does not vary. Accordingly, the paper sheets S fed from the upstream conveying path 9 into the paper sheet obverse and reverse side arranging device 85 at a uniform interval and speed are always fed out from the paper sheet obverse and reverse side arranging device 85 to the downstream conveying path 72 at a uniform interval and speed.

By the second embodiment described above, the same effects as the first embodiment can be demonstrated.

Furthermore, in the second embodiment, when a paper sheet requiring inversion is introduced to the belt conveyer 93 from either one of the inlet and outlet sections 105 and 106 by the sorting section 20, at the point when the center of the paper sheet requiring inversion in the conveying direction reaches the center of the forward and reverse conveying path 111 in the conveying direction, reverse operation control may be performed by outputting an instruction to reverse the belt conveyer 93 so that the paper sheet requiring inversion exits from that same inlet and outlet section 105 or 106.

What is claimed is:

1. A paper sheet obverse and reverse side arranging device, comprising:

a reversible conveying section which receives paper sheets including at least a paper sheet requiring inversion and a paper sheet not requiring inversion, the reversible conveying section including a rotor reversibly conveying the paper sheets in two directions opposite to each other;

a sorting section which is provided in an upstream conveying path upstream from the reversible conveying section;

two inlet and outlet sections provided upstream from the rotor, wherein the sorting section sorts the paper sheets to either one of the two inlet and outlet sections;

two guiding sections which are provided in the two inlet and outlet sections, respectively, and which guide paper sheets conveyed from the reversible conveying section;

two guide conveying sections which convey paper sheets guided from the reversible conveying section by the two guiding sections towards a downstream conveying path provided downstream; and a control section which controls the reversible conveying section and the sorting section.

2. The paper sheet obverse and reverse side arranging device according to claim 1, wherein the two inlet and outlet sections are disposed in close proximity, and a region on an outer peripheral surface of the reversible conveying section on a distant side of the two inlet and outlet sections constitutes a forward and reverse conveying path which reversibly conveys paper sheets.

3. The paper sheet obverse and reverse side arranging device according to claim 1, wherein the reversible conveying section includes a circular drum.

4. The paper sheet obverse and reverse side arranging device according to claim 1, wherein the guiding sections include an impeller.

5. The paper sheet obverse and reverse side arranging device according to claim 1, wherein in response to the sorting section introducing the paper sheet requiring inversion from one of the inlet and outlet sections to the reversible conveying section, the control section performs reverse operation control by reversing conveyance of the reversible conveying section so that the paper sheet requiring inversion exits from the one of the inlet and outlet sections, in response to the sorting section introducing the paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections, and the control section performs switching operation control to switch a sorting direction of the sorting section to an opposite side only during the reverse operation control.

6. The paper sheet obverse and reverse side arranging device according to claim 5, wherein the control section, during the reverse operation control, reverses conveyance of the reversible conveying section at a timing such that a trailing end of the paper sheet requiring inversion has at least passed the guiding section provided in the inlet and outlet section to which the paper sheet requiring inversion was introduced.

7. The paper sheet obverse and reverse side arranging device according to claim 5, wherein the control section, during the switching operation control, switches a sorting direction of the sorting section to an opposite side at a timing such that a trailing end of the paper sheet requiring inversion has at least passed the sorting section.

8. The paper sheet obverse and reverse side arranging device according to claim 1, wherein the two inlet and outlet sections, the two guiding sections, and the two guide conveying sections are disposed symmetrically about a line connecting the sorting section and the reversible conveying section.

9. The paper sheet obverse and reverse side arranging device according to claim 1, wherein a forward and reverse conveying path is provided between the two inlet and outlet sections on an opposite side to the sorting section side in the reversible conveying section, in response to the sorting section introducing the paper sheet requiring inversion from one of the inlet and outlet sections to the reversible conveying section, the control section, immediately prior to when a central region of the paper sheet requiring inversion reaches a central region of the forward and reverse conveying path, performs reverse operation control by supplying an instruction to the reversible conveying section to reverse conveyance so that the paper sheet requiring inversion exits from the one of the inlet and outlet sections, in response to the sorting section introducing the paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections, and the control section performs switching operation control to switch a sorting direction of the sorting section to an opposite side only during the reverse operation control.

10. The paper sheet obverse and reverse side arranging device according to claim 1, wherein a forward and reverse conveying path is provided between the two inlet and outlet sections on an opposite side to the sorting section side in the reversible conveying section, in response to the sorting section introducing the paper sheet requiring inversion from one of the inlet and outlet sections to the reversible conveying section, the control section, at a point when a central region of the paper sheet requiring inversion reaches a central region of the forward and reverse conveying path, performs reverse operation control by supplying an instruction to reverse the reversible conveying device so that the paper sheet requiring inversion exits from the one of the inlet and outlet sections, in response to the sorting section introducing the paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections, and the control section performs switching operation control to switch a sorting direction of the sorting section to an opposite side only during the reverse operation control.

11. The paper sheet obverse and reverse side arranging device according to claim 1, wherein the reversible conveying section includes only a single reversible conveying section.

12. The paper sheet obverse and reverse side arranging device according to claim 11, wherein the single reversible conveying section reverses a conveying direction thereof in response to receiving the paper sheet requiring inversion, and the single reversible conveying section does not change and keeps the conveying direction in response to receiving the paper sheet not requiring inversion.

13. The paper sheet obverse and reverse side arranging device according to claim 12, wherein the single reversible conveying section constitutes a portion of the conveying path used for reversing the paper sheet requiring inversion in a case of receiving the paper sheet requiring inversion, and the single reversible conveying section constitutes a portion of a conveying path used for conveying the paper sheet not requiring inversion in a case of receiving the paper sheet not requiring inversion.

14. The paper sheet obverse and reverse side arranging device according to claim 13, wherein the single reversible conveying section selectively constitutes at least one of: a portion of a conveying path used for reversing the paper sheet requiring inversion; and a portion of a conveying path used for conveying the paper sheet not requiring the inversion, depending on types of the paper sheets.

15. A paper sheet obverse and reverse side arranging device, comprising:

a reversible conveying section which includes a rotor reversibly conveying paper sheets in two directions opposite to each other;

a sorting section which is provided in an upstream conveying path upstream from the reversible conveying section;

two inlet and outlet sections provided upstream from the rotor, wherein the sorting section sorts the paper sheets to either one of the two inlet and outlet sections;

two guiding sections which are provided in the two inlet and outlet sections, respectively, and which guide paper sheets conveyed from the reversible conveying section;

two guide conveying sections which convey paper sheets guided from the reversible conveying section by the two guiding sections towards a downstream conveying path provided downstream; and a control section which controls the reversible conveying section and the sorting section, wherein in response to sorting section introducing a paper sheet requiring inversion from one of the inlet and outlet sections to the reversible conveying section, the control section performs reverse operation control by reversing conveyance of the reversible conveying section so that the paper sheet requiring inversion exits from the one of the inlet and outlet sections, in response to the sorting section introducing a paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections, and the control section performs switching operation control to switch a sorting direction of the sorting section to an opposite side only during the reverse operation control.

16. The paper sheet obverse and reverse side arranging device according to claim 15, wherein the control section, during the reverse operation control, reverses conveyance of the reversible conveying section at a timing such that a trailing end of the paper sheet requiring inversion has at least passed the guiding section provided in the inlet and outlet section to which the paper sheet requiring inversion was introduced.

17. The paper sheet obverse and reverse side arranging device according to claim 15, wherein the control section, during the switching operation control, switches a sorting direction of the sorting section to an opposite side at a timing such that a trailing end of the paper sheet requiring inversion has at least passed the sorting section.

18. A paper sheet obverse and reverse side arranging device, comprising:

a reversible conveying section which includes a rotor reversibly conveying paper sheets in two directions opposite to each other;

a sorting section which is provided in an upstream conveying path upstream from the reversible conveying section;

two inlet and outlet sections provided upstream from the rotor, wherein the sorting section sorts the paper sheets to either one of the two inlet and outlet sections;

two guiding sections which are provided in the two inlet and outlet sections, respectively, and which guide paper sheets conveyed from the reversible conveying section;

two guide conveying sections which convey paper sheets guided from the reversible conveying section by the two guiding sections towards a downstream conveying path provided downstream; and a control section which controls the reversible conveying section and the sorting section, wherein a forward and reverse conveying path is provided between the two inlet and outlet sections on an opposite side to the sorting section side in the reversible conveying section, in response to the sorting section introducing a paper sheet requiring inversion from one of the inlet and outlet sections to the reversible conveying section, the control section, immediately prior to when a central region of the paper sheet requiring inversion reaches a central region of the forward and reverse conveying path, performs reverse operation control by supplying an instruction to the reversible conveying section to reverse conveyance so that the paper sheet requiring inversion exits from the one of the inlet and outlet sections, in response to the sorting section introducing a paper sheet not requiring inversion from one of the inlet and outlet sections to the reversible conveying section, the control section performs continued operation control by not reversing conveyance of the reversible conveying section so that the paper sheet not requiring inversion exits from the other of the inlet and outlet sections, and the control section performs switching operation control to switch a sorting direction of the sorting section to an opposite side only during the reverse operation control.

* * * * *